US010794013B2

(12) United States Patent
Aldahir et al.

(10) Patent No.: US 10,794,013 B2
(45) Date of Patent: Oct. 6, 2020

(54) PLAYING SURFACE ASSEMBLIES AND SYSTEMS, AND METHODS OF MAKING AND USING SAME

(71) Applicant: COLUMBIA INSURANCE COMPANY, Omaha, NE (US)

(72) Inventors: Philipe Aldahir, Chattanooga, TN (US); Cab Bramlett, Dalton, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 16/667,439

(22) Filed: Oct. 29, 2019

(65) Prior Publication Data

US 2020/0131718 A1 Apr. 30, 2020

Related U.S. Application Data

(60) Provisional application No. 62/752,093, filed on Oct. 29, 2018.

(51) Int. Cl.
*E01C 13/08* (2006.01)
*A41G 1/00* (2006.01)

(52) U.S. Cl.
CPC ..... *E01C 13/08* (2013.01); *D10B 2505/202* (2013.01)

(58) Field of Classification Search
CPC ..... E01C 13/00; E01C 13/045; E01C 13/08; E01C 13/083; E01C 13/10; A63C 19/00; A63C 19/04; A63C 19/06
USPC ..... 472/88, 92–94; 428/15, 17, 87
See application file for complete search history.

(56) References Cited

U.S. PATENT DOCUMENTS

2002/0081399 A1* 6/2002 Prevost ..... E01C 13/045 428/17
2005/0158482 A1 7/2005 Cook
2008/0145574 A1* 6/2008 Julicher ..... E01C 13/08 428/17
2011/0081506 A1 4/2011 Lee
2012/0230777 A1 9/2012 Ayers et al.
(Continued)

FOREIGN PATENT DOCUMENTS

WO PCT/US2019/058560 10/2019

OTHER PUBLICATIONS

U.S. Appl. No. 62/752,093, filed Oct. 29, 2018, Philipe Aldahir.
(Continued)

*Primary Examiner* — Kien T Nguyen
(74) *Attorney, Agent, or Firm* — Ballard Spahr LLP

(57) ABSTRACT

A playing surface assembly that defines at least a portion of a playing surface. The playing surface assembly has a backing, a plurality of reinforcement elements secured to and extending upwardly from the backing, and an infill material defining a top surface of the playing surface assembly. Each reinforcement element has a top end and a reveal distance corresponding to a vertical spacing between the top surface of the playing surface assembly and the top end of the reinforcement element. The reveal distance of each reinforcement element is less than 0.5 inches. In use, the reinforcement elements restrict lateral and vertical migration of the infill material, and the infill material is the primary source of performance characteristics of the playing surface assembly.

27 Claims, 5 Drawing Sheets

(56) References Cited

U.S. PATENT DOCUMENTS

2013/0243976 A1* 9/2013 Lee ..... C08L 23/12
428/17

OTHER PUBLICATIONS

International Search Report and Written Opinion were dated Jan. 14, 2020 by the International Searching Authority for International Application No. PCT/US2019/058560, filed on Oct. 29, 2019 (Applicant-Shaw Industries Group,Inc.) (7 Pages).

* cited by examiner

PLAYING SURFACE ASSEMBLIES AND SYSTEMS, AND METHODS OF MAKING AND USING SAME

CROSS-REFERENCE TO RELATED APPLICATION

This application claims priority to and the benefit of the filing date of U.S. Provisional Patent Application No. 62/752,093, filed Oct. 29, 2018, which is incorporated herein by reference in its entirety.

FIELD

The disclosed invention relates to playing surface assemblies for use in forming respective portions of a playing surface, such as a field, court, or track.

BACKGROUND

Baseball fields typically include three distinct playing surfaces: grass, skinned areas (including the pitching mound, the hitting area, the base paths, and portions of the infield) and the warning track. Most of the game is played on the skinned areas, which are typically formed of clay mixes with added soil amendments and/or conditioners. The grass area is the largest portion (by area) of the field, but it is also the least used, with only three players (outfielders) positioned there. Similar to the skinned areas, the warning track is typically a non-grassed area with loose particulate on the surface. The goal of the warning track is to increase player awareness of a potential upcoming collision with a fence or wall.

Current artificial baseball fields use the same type of grass-like artificial turf to replicate all three of these areas. Typically, such grass-like artificial turf is infilled with recycled rubber crumbs. These artificial field constructions have not only changed the way the game is played (in comparison to traditional/natural fields), but also reduced safety, particularly on the warning track area, and interfered with ball and athlete interaction on the skinned areas. In particular, due to the consistency of the artificial turf used for each area of the field, current artificial baseball fields do not adequately simulate the significant differences in playability between the grassed and non-grassed areas of the field.

More generally, because conventional artificial turf fields have consistent properties defined primarily by the synthetic turf fibers or ribbons, such artificial turf fields are not suitable for replicating or approximating variations in playability and other performance characteristics within the field.

SUMMARY

Described herein, in various aspects, is a playing surface assembly that defines at least a portion of a playing surface, such as a baseball field, a softball field, a tennis court, a track (e.g., horse track), and the like. The playing surface assembly can comprise a backing, a plurality of reinforcement elements, and an infill material. The backing can have a top surface. The plurality of reinforcement elements can be secured to and extend upwardly from the backing. The infill material defines a top surface of the playing surface assembly and has a height measured from the top surface of the backing. Each reinforcement element of the plurality of reinforcement elements can have a top end and a reveal distance corresponding to a vertical spacing between the top surface of the playing surface assembly and the top end of the reinforcement element. A ratio between the height of the infill material and the reveal distance of each reinforcement element can be at least 7:1. Stated differently, a ratio between the reveal distance and a total height of the reinforcement element is less than or equal to 1:8 (0.125). Optionally, the reveal distance of each reinforcement element can be less than 0.5 inches. The plurality of reinforcement elements can be configured to restrict lateral and vertical migration of the infill material, and the infill material serves as the primary source of performance characteristics of the playing surface assembly. In use, the players on the playing surface assembly will directly interact with the infill material, which will determine the overall performance and playability of the playing surface assembly.

Also described are systems including a first playing surface assembly as discussed above. Such systems can also include a second playing surface assembly that cooperates with the first playing surface assembly to define at least a portion of a playing field, court, or track.

Methods of using the disclosed playing surface assemblies are also described. Optionally, such methods can comprise modifying one or more properties of the infill material to adjust one or more playing characteristics of the playing surface assembly. Optionally, the methods can comprise watering the playing surface assembly to adjust one or more playing characteristics of the playing surface assembly.

Methods of making the disclosed playing surface assemblies are also described.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
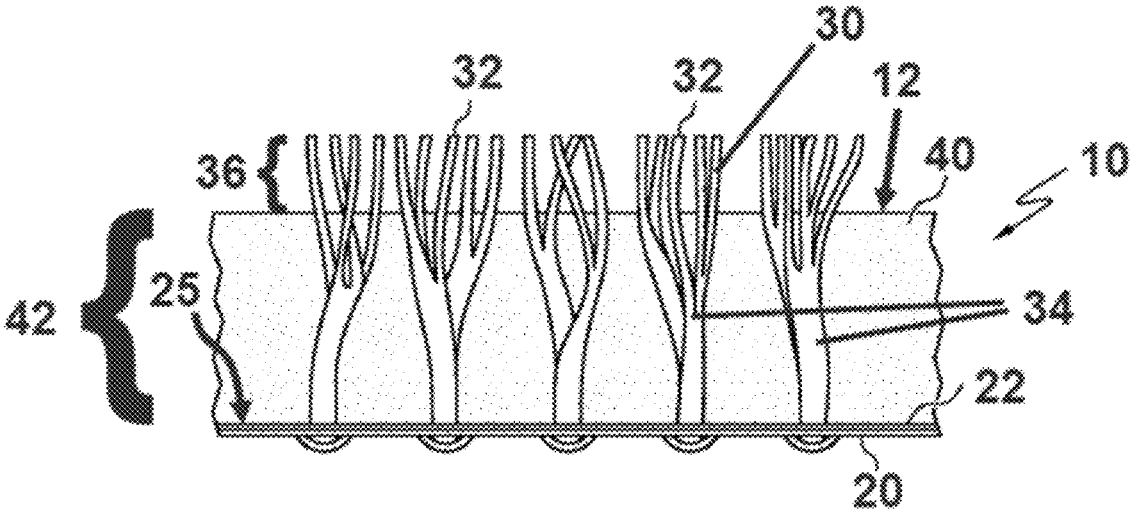
FIG. 1 is a side view of an exemplary playing surface assembly as disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "a backing" can refer to one or more of such backings, and so forth.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, in some optional aspects, when values are approximated by use of the term "substantially" or "substantially equal," it is contemplated that values within up to 15%, up to 10%, up to 5%, or up to 1% (above or below) of the particular value can be included within the scope of those aspects.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the definition of the term "color" is referenced in terms of the CIELAB color scale, which was created by the International Commission on Illumination (CIE). The CIELAB color scale provides a uniform scale for measuring and comparing the color values of different samples. Three different color measurements are used to determine the CIELAB color value of a given sample: 1) a white-black color measurement; 2) a red-green color measurement; and 3) a yellow-blue color measurement. The white-black color measurement represents the amount of white present in the sample relative to the amount of black present in the sample. The red-green color measurement represents the amount of red present in the sample relative to the amount of green present in the sample. The yellow-blue color measurement represents the amount of yellow present in the sample relative to the amount of blue present in the sample. CIELAB color scale values can be obtained using color measurement instruments known in the art, including, for example, HunterLab color measurement instruments. When two "colors" are referred to as being the same or "substantially" the same or matching or "substantially" matching, it should be understood that each of the three color measurements (in the CIELAB scale) for the colors being compared are equal or substantially equal.

The term "backing" as used herein includes both primary backing materials and secondary backing materials. The term "backing" refers to any conventional backing material that can be applied to a tufted product, such as a woven, a non-woven, a knitted, a needle punched fabric, as well as a stitch bonded primary backing material. As one skilled in the art will appreciate, materials such as polypropylene, polyesters, hemp, composites, blend, nylons, or cottons can be used to form the backing material.

The term "fiber" as used herein includes fibers of extreme or indefinite length (i.e. filaments) and fibers of short length (i.e., staple fibers).

The term "yarn" as used herein refers to a continuous strand or bundle of fibers. Such yarns can include, for example and without limitation, monofilament yarns, cut yarns, looped yarns, fibrillated yarns, multifilament yarns, twisted yarns, wrapped yarns, and the like. Optionally, yarns can be textured using conventional methods.

The term "artificial turf ribbon" as used herein refers to a yarn that has a reveal distance of at least 0.75 inches as further disclosed herein.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIGS. 1-6B, are playing surface assemblies 10 that can be used to form a playing field. Unlike conventional artificial turf fields, the disclosed playing surface assemblies utilize artificial grass fibers only as a stabilizer or reinforcement of the infill materials for both non-grassed areas (skinned areas and warning track, for example). As further described herein, only a small amount of the artificial grass fibers of the playing surface assemblies are visible above the infill material. In fact, up to 99% of the volume of the artificial grass fibers extending above the backing is buried in the infill material that most appropriately replicates the performance and playability of natural baseball surfaces. Thus, the reinforcing artificial grass fibers and yarns disclosed herein do not serve as or define the playing matrix for the playing field. Rather, the chosen infill materials are the playing matrix, with the reinforcement elements described herein cooperating to avoid displacement and erosion of the infill materials. In contrast to conventional grass fibers, the grass fibers in the disclosed playing surface assemblies can act as stabilizing yarns or reinforcement elements for controlling displacement of the infill material. In some embodiments, the reinforcement elements can comprise nylon, polypropylene, polyethylene, EVA, or TPU. In further embodiments, the reinforcement elements can comprise a mixture of polymers. The reinforcement elements can be textured (like grass thatch or knot de-knit) or straight. The reinforcement fibers can optionally have bundle denier ranges of between 3,000 and 20,000. Additionally, in contrast to conventional artificial turf fields, the disclosed playing surface assemblies provide the unique ability to alter playability parameters by altering infill characteristics, such as materials, compaction, water content, depth, and the like, similar to alteration of a natural baseball field. For example, for high performance applications such as for professional sports, stiffer reinforcement elements can be used. Further, the surface assembly can have more reinforcement elements or otherwise be configured to more effectively reinforce the infill and prevent movement of the infill through the reinforcement elements. In this way, the playing surface can more accurately mimic an actual skinned surface area. In uses for lower performance applications, the playing surface can allow more infill movement and displacement to thereby increase foot release.

In exemplary aspects, the playing surface assembly 10 can define at least a portion of a playing surface 100, such as a field, a court, or a track. In these aspects, the playing surface assembly 10 can comprise a backing 20 having a top surface 25. It is contemplated that the backing 20 can have any conventional structure that is suitable for supporting a particular playing surface assembly as described further herein. In exemplary aspects, the backing 20 can comprise a single layer of backing material. Alternatively, in other exemplary aspects, the backing 20 can comprise a plurality of layers, such as, for example and without limitation, a primary backing layer and at least one secondary backing layer (optionally, a plurality of secondary backing layers). Optionally, in some aspects, the backing can be a woven backing. Optionally, in other aspects, the backing can be a non-woven backing. Optionally, in some aspects, the backing can be permeable to liquid. Optionally, in other aspects, the backing can be impermeable to liquid. Optionally, as shown in FIG. 1, the backing 20 can comprise at least one coating or film 22 configured to increase durability of the playing surface assembly. Exemplary coatings or films can comprise polyurethane, which optionally can include fillers that are configured to increase durability of the playing surface assembly. Optionally, the polyurethane can be sprayed over another layer of the backing. In further exemplary aspects, the coating or film 22 can comprise a laminated film. Optionally, the coating or film 22 can comprise a layer of extruded polyethylene. In other optional aspects, it is contemplated that the coating or film 22 can comprise a hot melt or powder coating comprising polymeric compounds. In further optional aspects, it is contemplated that the coating or film 22 can comprise a UV-curable coating, such as an ink, glue, adhesive, film, or combinations thereof. In exemplary applications, it is contemplated that such coatings or films can be suitable for reinforcing the areas of a playing surface assembly used to form a pitching mound. In further exemplary aspects, the coating or film 22 can serve as a filter that adjusts a level of moisture retention within the playing surface assembly 10. Optionally, in these aspects, the coating or film 22 can be configured to direct or return water to the top surface of the infill material to thereby impact play characteristics. In one example, it is contemplated that the coating or film 22 can be the most flow-restricting layer of the playing surface assembly 10, thereby allowing water to remain within the playing surface profile and be wicked up through the infill material in accordance with the capillary properties of the infill material, the environmental conditions (evaporation, temperature), and differences in matrix potential between the atmosphere and the playing surface assembly 10 (consistent with the $2^{nd}$ law of thermodynamics, all matter tries to return to a state of least potential energy).

In further aspects, the playing surface assembly 10 can comprise a plurality of reinforcement elements 30 secured to and extending upwardly from the backing. Optionally, in some aspects, it is contemplated that the plurality of reinforcement elements 30 can be tufted into the backing using conventional processes. In various aspects, the plurality of reinforcement elements 30 can comprise fibers, yarns, or combinations thereof. In one aspect, the plurality of tufted reinforcement elements 30 can comprise cut yarns. Additionally, or alternatively, the plurality of tufted reinforcement elements 30 can comprise loop yarns. Additionally, or alternatively, the plurality of tufted reinforcement elements 30 can comprise monofilament fibers. Additionally, or alternatively, the plurality of tufted reinforcement elements 30 can comprise slit films. Additionally, or alternatively, the plurality of tufted reinforcement elements 30 can comprise one or more twisted variations of any of the above-identified yarn types. More generally, it is contemplated that the plurality of tufted reinforcement elements 30 can comprise any type of yarn or fiber or any combination of multiple types of yarns or fibers. Optionally, in further aspects, the plurality of reinforcement elements 30 can be integrally formed with the backing 20 as a single monolithic structure. For example, in exemplary aspects, the backing 20 can comprise a three-dimensionally structured non-woven layer that can be coated and configured to house infill.

Optionally, in still further aspects, it is contemplated that the plurality of reinforcement elements 30 can be held together by the coating or film 22. Additionally, or alternatively, it is contemplated that the plurality of reinforcement elements 30 can be held together by a binder.

In additional aspects, the playing surface assembly can comprise an infill material 40 defining a top surface 12 of the playing surface assembly 10 and having a height 42 measured from the top surface 25 of the backing 20. In these aspects, it is contemplated that the infill material 40 can comprise a single component or any combination of a plurality of components. When the infill material 40 comprises a plurality of components, it is contemplated that the infill material can optionally comprise a plurality of layers, with each layer corresponding to a different infill component or combination of components. Alternatively, it is contemplated that the plurality of components can be provided as a mixture, which can be either homogenous or non-homogenous. In exemplary aspects, it is contemplated that the infill material 40 can comprise clay. In these aspects, the clay can be either porous or non-porous. Optionally, it is contemplated that the clay can have a serve size of greater than 20 mm or ranging from about 10 to about 60 mesh (consistent with ASTM 5644) or from about 20 to about 40 mesh. It has been found that clay having a serve size of less than 10 mm was too large to properly settle below the top ends of the reinforcement members—rather, such clays "floated" at the top of the reinforcement members. Optionally, in exemplary aspects, the infill material can comprise recycled particulate material. Additionally or alternatively, it is contemplated that the infill material can comprise TPE, EPDM, coconut husks, walnut shells, crushed brick, sand, or combinations thereof. More generally, it is contemplated that the infill material can comprise any material that is suitable for imparting selected characteristics to a playing surface as disclosed herein. Optionally, in exemplary aspects, the plurality of reinforcement elements can have a color that matches or substantially matches a color of the infill material (or at least the portion of the infill material defining a color of the top surface 12 of the playing surface assembly 10). Alternatively, it is contemplated that the plurality of reinforcement elements can have a color that is different than the color of the infill material. Optionally, some aspects, it is contemplated that the infill material can include multiple colors. In these aspects, it is contemplated that the plurality of reinforcement elements can have a color that matches or substantially matches a single color of the multiple colors of the infill material. Alternatively, it is contemplated that a first portion of the reinforcement elements can have a color that matches or substantially matches a first color of the multiple colors of the infill material, while a second portion of the reinforcement elements can have a color that matches or substantially matches a second color of the multiple colors of the infill material.

As shown in FIG. 1, each reinforcement element 30 of the plurality of reinforcement elements 30 can have a top end 32 and a reveal distance 36 corresponding to a vertical spacing between the top surface 12 of the playing surface assembly 10 (defined by the infill material 40) and the top end 32 of the reinforcement element 30. In combination, the sum of the height 42 of the infill material and the reveal distance 36 correspond to a total height of each reinforcement element 30. In exemplary aspects, a ratio between the height 42 of the infill material 40 and the total height of each reinforcement element is at least 0.875 (optionally, at least 0.9 or at least 0.95). Stated differently, in these aspects, a ratio between the height 42 of the infill material and the reveal distance 36 and is greater than or equal to 7:1, and a ratio between the reveal distance 36 and the total height of the corresponding reinforcement element is less than or equal to 0.125 (optionally, less than 0.1 or less than 0.05). Optionally, in exemplary aspects, the reveal distance of each reinforcement element is less than 0.25 inches. Optionally, in still further exemplary aspects, the reveal distance of at least a portion of the reinforcement elements of the plurality of reinforcement elements have a reveal distance that is less than 0.125 inches.

In additional aspects, it is contemplated that each reinforcement element of the plurality of reinforcement elements can have an upper portion positioned above the backing. Optionally, in these aspects, at least 80% of a surface area or volume of the upper portion of each reinforcement element can be embedded within the infill material (and not visible). Optionally, at least 90% of the surface area or volume of the upper portion of each reinforcement element can be embedded within the infill material (and not visible). Optionally, at least 95% of the surface area or volume of the upper portion of each reinforcement element can be embedded within the infill material (and not visible).

In use, the plurality of reinforcement elements 30 can be configured to restrict lateral and vertical migration of the infill material, and the infill material is the primary source of performance characteristics of the playing surface assembly. As further described herein, because the reinforcement elements 30 merely serve to reinforce the infill material (rather than defining the playing surface), the infill material serves as the primary playing surface. As used herein, the "performance characteristics of the playing surface assembly" can include, for example and without limitation, g-max, head injury criterion (HIC), Advanced Artificial Athlete (AAA) (e.g., vertical deformation, force reduction, and energy restitution), shear vane, rotational traction, and combinations thereof. Optionally, it is contemplated that these performance characteristics can be expressed in the form of a playability score in the manner described in U.S. Provisional Patent Application No. 62/727,862, filed on Sep. 6, 2018, and U.S. Nonprovisional patent application Ser. No. 16/563,684, filed on Sep. 6, 2019, which are incorporated herein by reference in their entireties. Additional details of these performance characteristics and the playability score are described below in the "Performance Metrics" and "Playability Assessment Tool" sections of this application.

Other exemplary performance characteristics of the playing surface assembly include moisture content (measured as volumetric water content), friction (measured in accordance with the procedure of ASTM F1015-03), and ball bounce and pace, which can be determined using conventional video analysis in accordance with conventional methods.

In use, the backing 20 can separate the drainage system of the playing surface (e.g., field) from the performance system. It is further contemplated that the backing 20 can anchor the infill material matrix. It is contemplated that the backing can be selectively adjusted to restrict or encourage a wide range of water percolation. Optionally, a pad or cushion (not shown) can be embedded with an upper portion of the backing. In exemplary aspects, the pad or cushion can be a rubber pad, a polymeric pad (such as, a polypropylene (PP) and/or polyethylene (PE) pad), a rebond pad, a fiber pad, a recycled turf pad, and the like. In use, it is contemplated that the pad or cushion can be configured to enhance safety for players while preserving desired playing characteristics of the playing surface.

Optionally, in exemplary aspects, the playing surface assembly 10 can comprise an underlayment assembly (not shown) as is known in the art. Exemplary underlayment assemblies include shock or performance pads as are known in the art. In these aspects, the backing 20 can be positioned over (and in contact with) a top surface of the underlayment assembly. In conventional turf systems, underlayment assemblies can be configured for shock absorption. According to some aspects, the underlayment assembly can be configured to control ball bounce trajectory and pace and, thus, speed of play. One such underlayment assembly is described in U.S. patent application Ser. No. 16/373,338 to Aldahir et al., filed Apr. 2, 2019, which is hereby incorporated by reference herein in its entirety. Additional details of such an underlayment assembly are provided below in the "Exemplary Underlayment Assembly" section of this application. According to still further aspects, it is contemplated that decreasing a ratio of rubber crumb in the infill can increase playability.

Optionally, in addition to the plurality of reinforcement elements, the playing surface assembly can further comprise a plurality of secondary reinforcement elements (not shown) that are completely embedded within the infill material. That is, it is contemplated that each secondary reinforcement element of the plurality of secondary reinforcement elements can have a pile height that is less than the height 42 of the infill material 40. Like reinforcement elements 30, the secondary reinforcement elements are secured to and extend upwardly from the backing. Optionally, in some aspects, it is contemplated that the plurality of secondary reinforcement elements can be tufted into the backing using conventional processes. In various aspects, the plurality of secondary reinforcement elements can comprise fibers, yarns, or combinations thereof. In one aspect, the plurality of secondary reinforcement elements can comprise cut yarns. Additionally, or alternatively, the plurality of secondary reinforcement elements can comprise loop yarns. Additionally, or alternatively, the plurality of secondary reinforcement elements can comprise monofilament fibers. Additionally, or alternatively, the plurality of secondary reinforcement elements can comprise slit films. Additionally, or alternatively, the plurality of secondary reinforcement elements can comprise thatch yarns. More generally, it is contemplated that the plurality of secondary reinforcement elements can comprise any type of yarn or fiber or any combination of multiple types of yarns or fibers. Optionally, in further aspects, the plurality of secondary reinforcement elements can be integrally formed with the backing as a single monolithic structure. Optionally, in still further aspects, it is contemplated that the plurality of secondary reinforcement elements can be held together by a binder in the same manner as reinforcement elements 30.

For an exemplary embodiment of a baseball or softball field, a pitching mound can have the following properties: The yarns can have a linear density (Denier Tape) according to ASTM D1577-07 of 7,500-8,500 denier (preferably, 8000 denier), a tape thickness according to ASTM D3218.07 of 75-125 microns (preferably, 100 microns), a tape break strength according to ASTM D2256-10 of 15-25 lbs-force (preferably, 20 lbs-force), an elongation (mono and tape) according to ASTM D2256-10 of greater than 20% (preferably, greater than 30%), and a total lead content according to ASTM F2765-10 of less than 125 ppm (preferably, less than 100 ppm). The turf fabric can have a total product weight, according to ASTM 55848-10e1, of 70-85 oz/yd$^2$ (preferably, 79 oz/yd$^2$), a pile yarn fiber weight, according to ASTM 55848-10e1, of 45-55 oz/yd$^2$ (preferably, 51 oz/yd$^2$), a primary backing weight, according to ASTM 55848-10e1, of at least 5 oz/yd$^2$ (preferably, at least 8 oz/yd$^2$), a secondary backing weight, according to ASTM 55848-10e1, of 15-25 oz/yd$^2$ (preferably, 20 oz/yd$^2$), an average pile height, according to ASTM D5284-13, of 1.5-2 inches (preferably, 1.75 inches), an average tuft bind strength, according to D1335-12, of greater than 7.5 lbs-force (preferably, greater than 10 lbs-force), a tufting gauge, according to ASTM D5793-05 of 0.15-0.35 inches (preferably, ¼ inch), an average grab tear strength, according to D5034-09 of greater than 150 lbs-force (preferably, greater than 200 lbs-force). The system can have infiltrometer drainage, according to ASTM BS 7044 Method 4 of greater than 20 in/hr (preferably, greater than 25 in/hr).

Exemplary skinned areas, such as infield areas, hitting areas, and base paths, can have the following properties: The yarns can have a linear density (Denier Tape) according to ASTM D1577-07 of 7,500-8,500 denier (preferably, 8000 denier), a tape thickness according to ASTM D3218.07 of 75-125 microns (preferably, 100 microns), a tape break strength according to ASTM D2256-10 of 15-25 lbs-force (preferably, 20 lbs-force), an elongation (mono and tape) according to ASTM D2256-10 of greater than 25% (preferably, greater than 30%), and a total lead content according to ASTM F2765-10 of less than 125 ppm (preferably, less than 100 ppm). The turf fabric can have a total product weight, according to ASTM 55848-10e1, of 75-90 oz/yd$^2$ (preferably, 83 oz/yd$^2$), a pile yarn fiber weight, according to ASTM 55848-10e1, of 50-60 oz/yd$^2$ (preferably, 55 oz/yd$^2$, a primary backing weight, according to ASTM 55848-10e1, of at least 5 oz/yd$^2$ (preferably, at least 8 oz/yd$^2$), a secondary backing weight, according to ASTM 55848-10e1, of 15-25 oz/yd$^2$ (preferably, 20 oz/yd$^2$), an average pile height, according to ASTM D5284-13, of 1.5-1.75 inches (preferably, 1.625 inches), an average tuft bind strength, according to D1335-12, of greater than 7.5 lbs-force (preferably, greater than 10 lbs-force), a tufting gauge, according to ASTM D5793-05 of 0.25-0.5 inches (preferably, ⅜ inch), an average grab tear strength, according to D5034-09 of greater than 150 lbs-force (preferably, greater than 200 lbs-force). The system can have infiltrometer drainage, according to ASTM BS 7044 Method 4 of greater than 20 in/hr (preferably, greater than 25 in/hr).

An exemplary warning track can have the following properties: The yarns can have a linear density (Denier Tape) according to ASTM D1577-07 of 7,500-8,500 denier (preferably, 8000 denier), a tape thickness according to ASTM D3218.07 of 75-125 microns (preferably, 100 microns), a tape break strength according to ASTM D2256-10 of 15-25 lbs-force (preferably, 20 lbs-force), an elongation (mono and tape) according to ASTM D2256-10 of greater than 20% (preferably, greater than 30%), and a total lead content according to ASTM F2765-10 of less than 125 ppm (preferably, less than 100 ppm). The turf fabric can have a total product weight, according to ASTM 55848-10e1, of 40-50 oz/yd$^2$ (preferably, 45 oz/yd$^2$), a pile yarn fiber weight, according to ASTM 55848-10e1, of 15-20 oz/yd$^2$ (preferably, 17 oz/yd$^2$), a primary backing weight, according to ASTM 55848-10e1, of at least 5 oz/yd$^2$ (preferably, at least 8 oz/yd$^2$), a secondary backing weight, according to ASTM 55848-10e1, of 15-25 oz/yd$^2$ (preferably, 20 oz/yd$^2$), an average pile height, according to ASTM D5284-13, of 1.5-1.75 inches (preferably, 1.625 inches), an average tuft bind strength, according to D1335-12, of greater than 7.5 lbs-force (preferably, greater than 10 lbs-force), a tufting gauge, according to ASTM D5793-05 of ⅜ inch to ⅝ inch (preferably, ½ inch), an average grab tear strength, according to D5034-09 of greater than 150 lbs-force (preferably, greater than 200 lbs-force. The system can have infiltrometer drainage, according to ASTM BS 7044 Method 4 of greater than 15 in/hr (preferably, greater than 20 in/hr).

Figure 2:
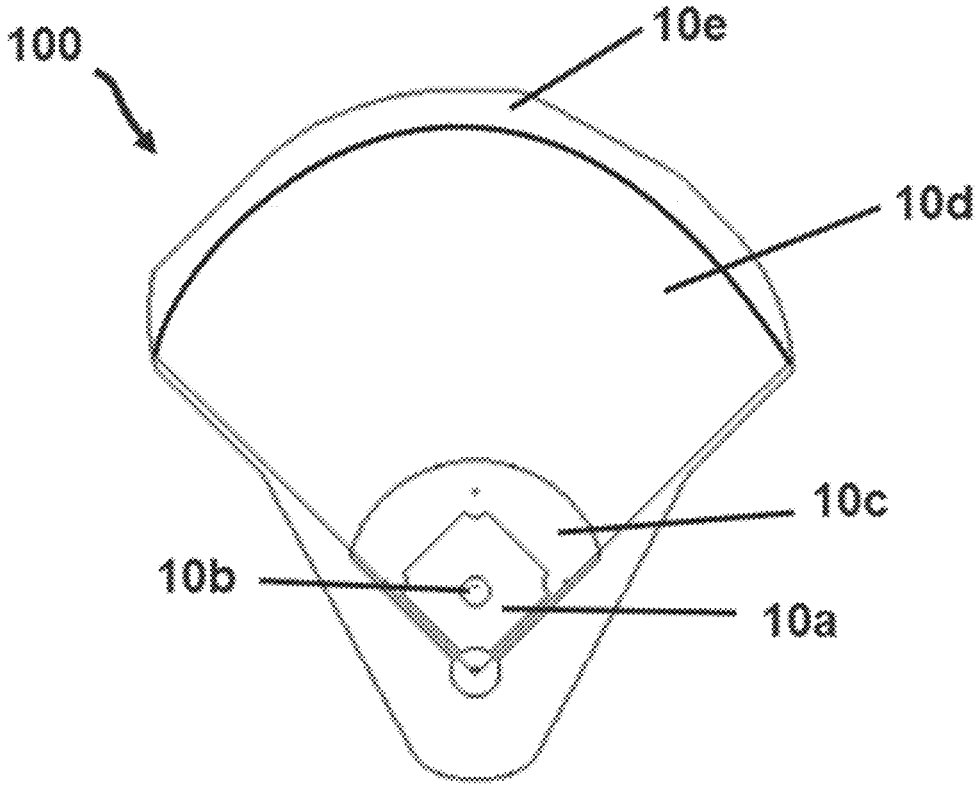
FIG. 2 is a top view of an exemplary baseball field formed from a plurality of playing surface assemblies.
Figure 3A:
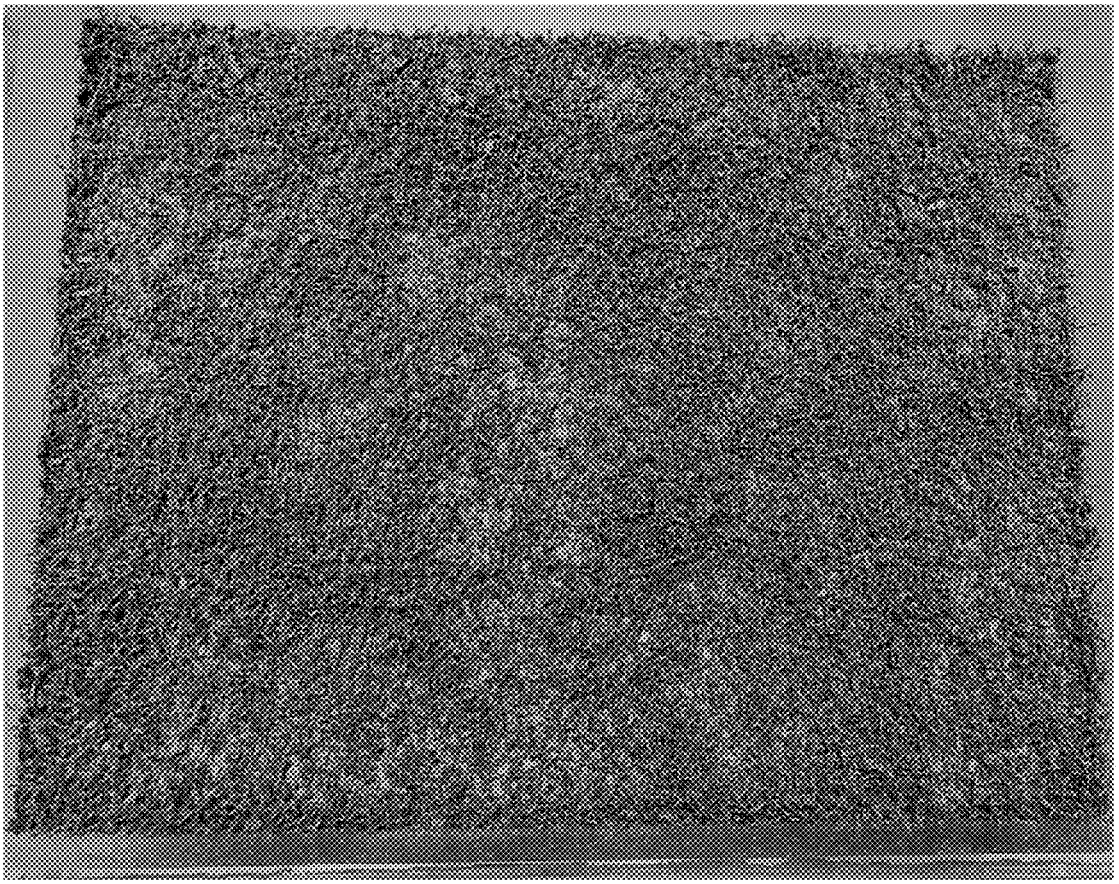
FIGS. 3A-3B are images providing top and side views of an example playing surface assembly as disclosed herein.
Figure 3B:
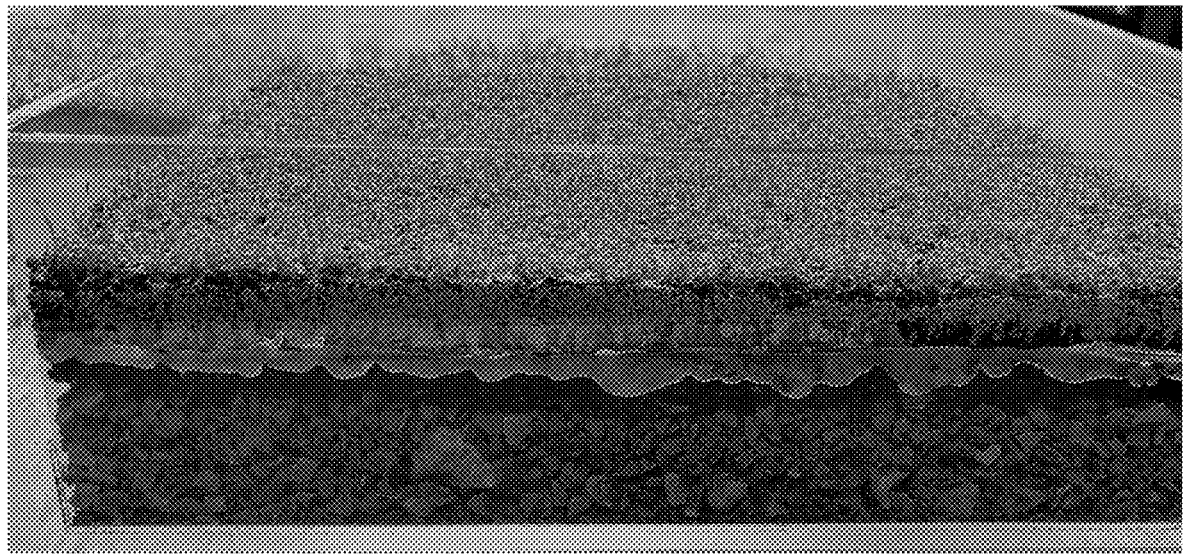
Figure 4A:
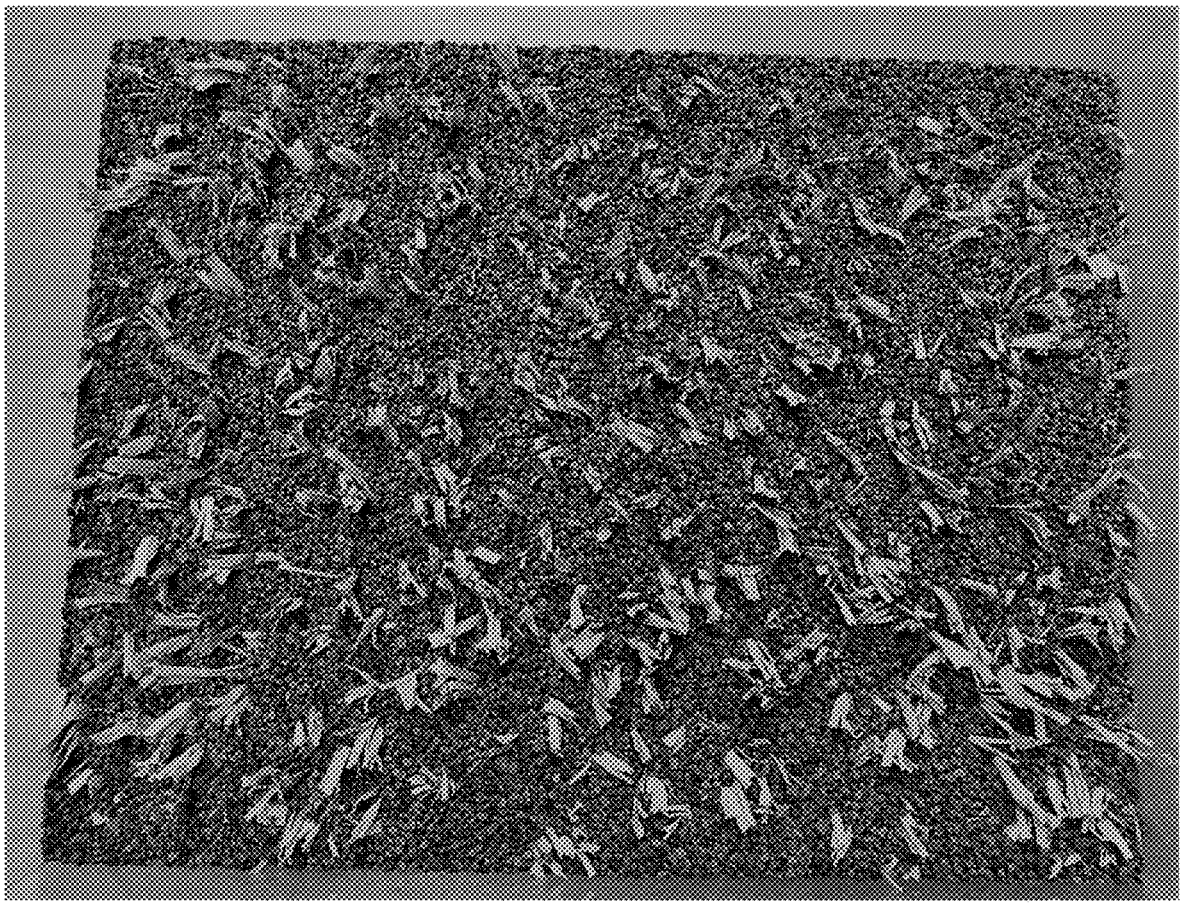
FIGS. 4A-4B are images providing top and side views of an example playing surface assembly as disclosed herein.
Figure 4B:
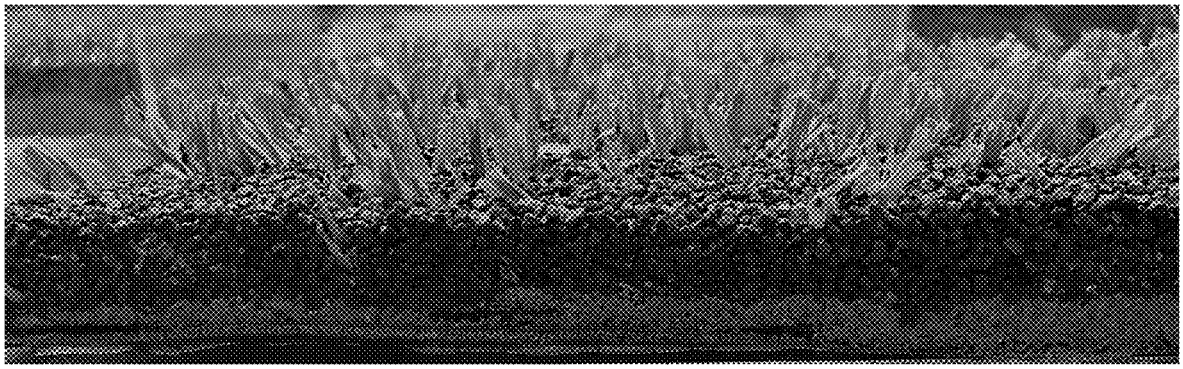
Figure 5A:
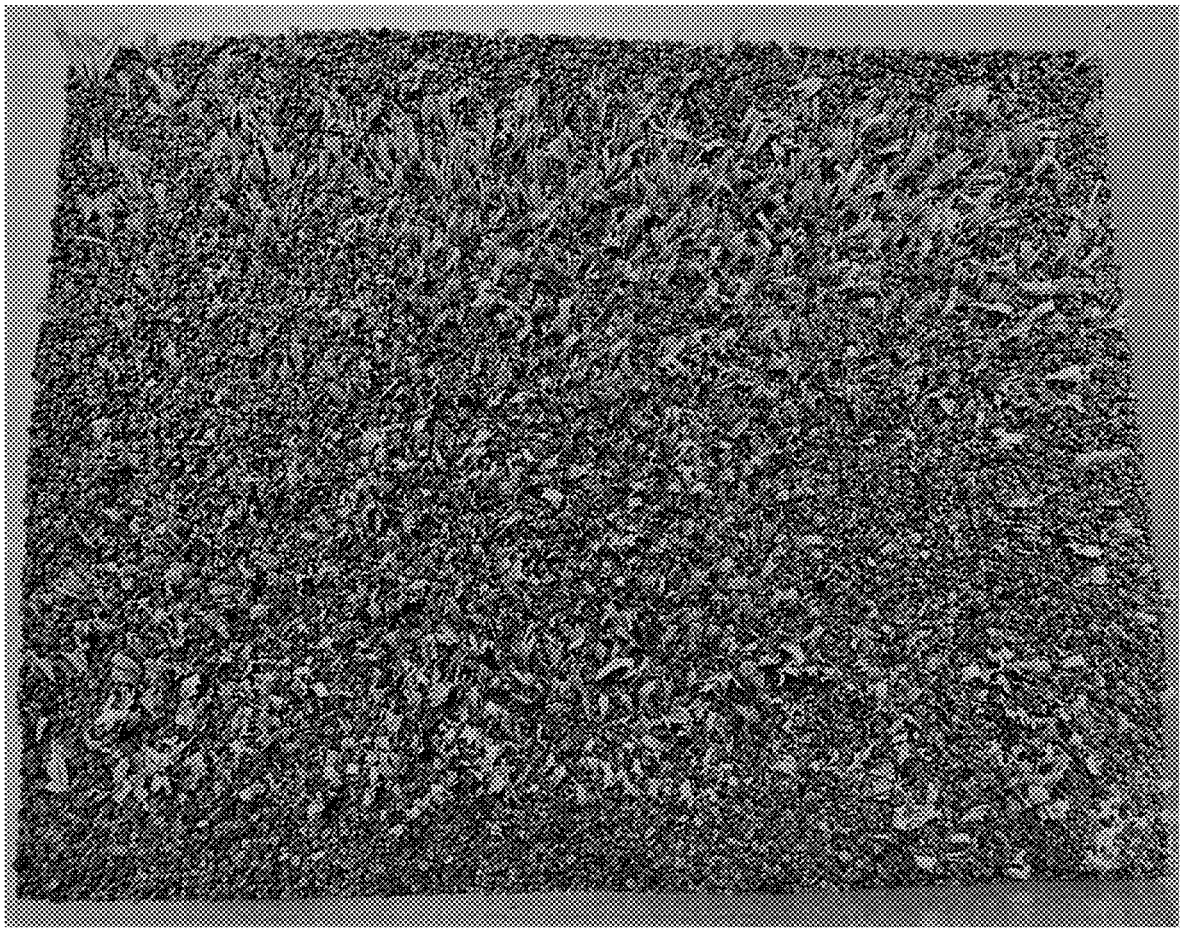
FIGS. 5A-5B are images providing top and side views of an example playing surface assembly as disclosed herein.
Figure 5B:
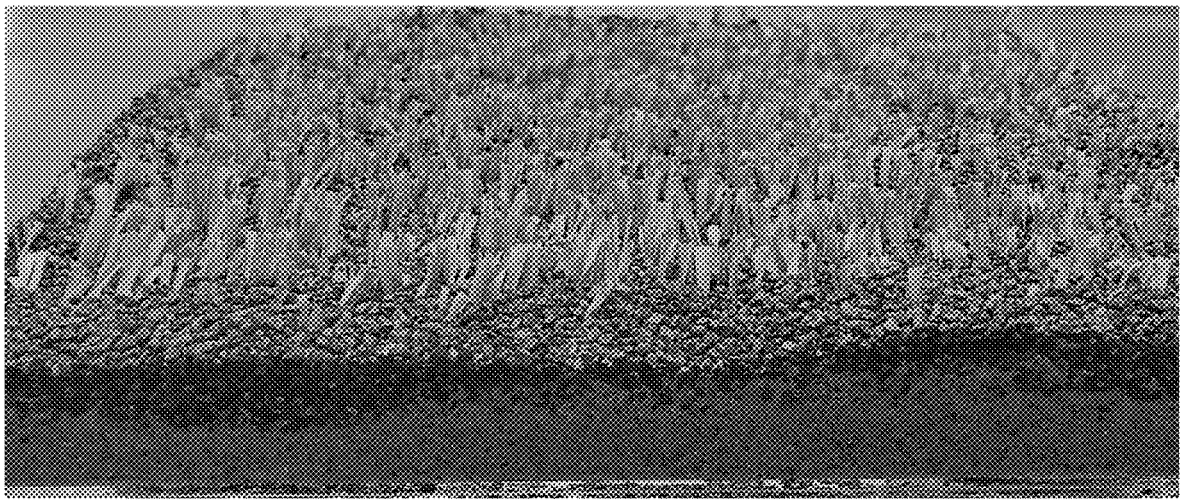
Figure 6A:
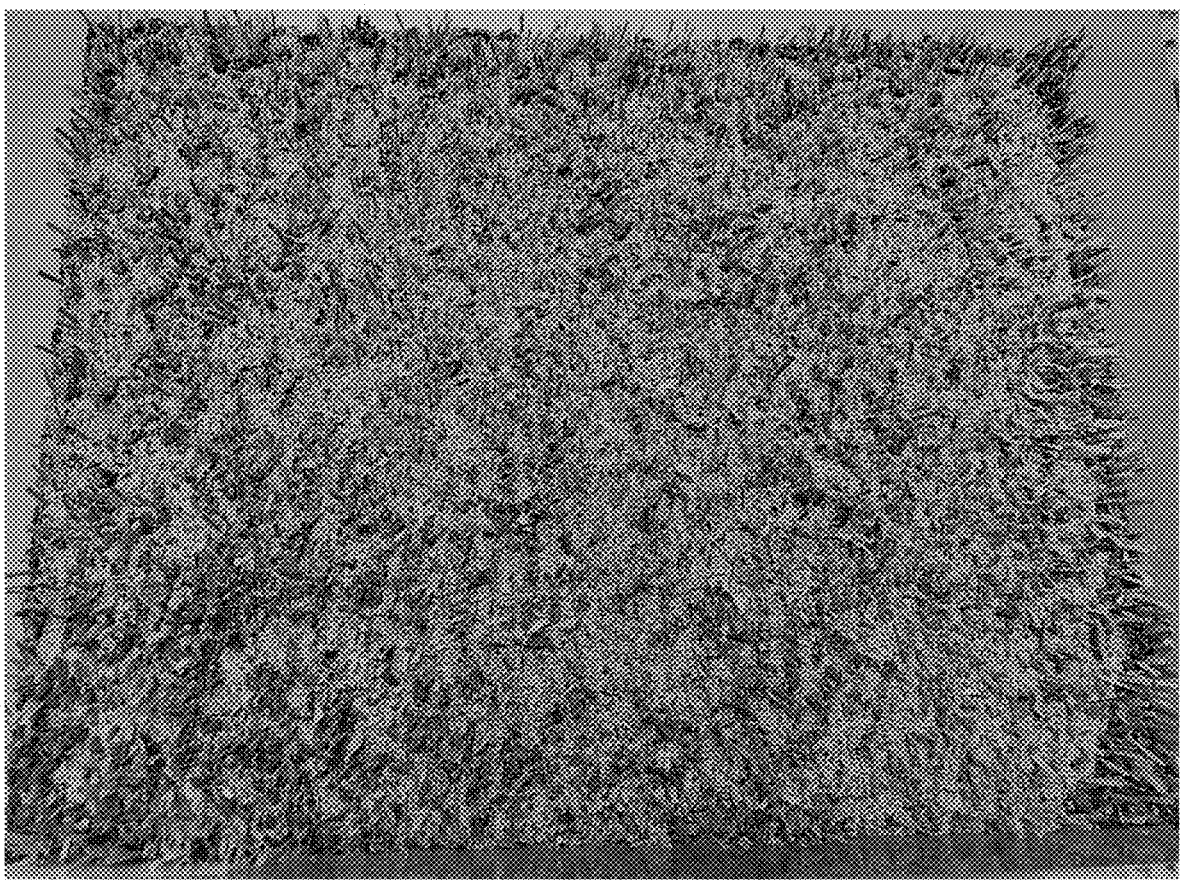
FIGS. 6A-6B are images providing top and side views of an example playing surface assembly as disclosed herein.
Figure 6B:
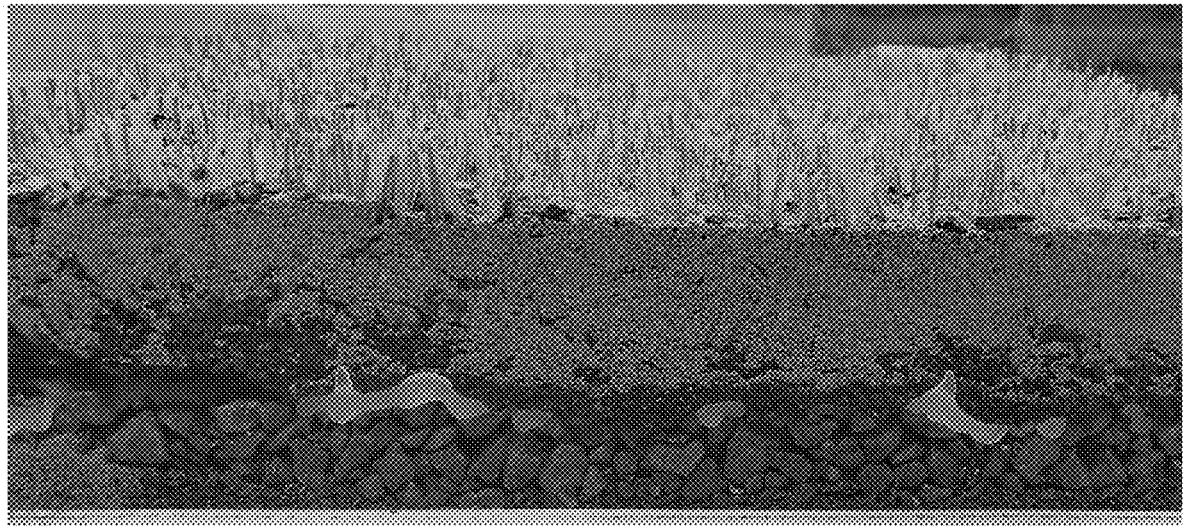

In various aspects, systems comprising a playing surface assembly 10 can be provided. Optionally, in these aspects, the system can correspond to a playing surface 100 as shown in FIG. 2. For example, it is contemplated that the playing surface assembly 10 can be provided as a first playing surface assembly 10*a*, with a second playing surface assembly cooperating with the first playing surface assembly to define the playing surface 100 or a portion of a playing surface, such as a playing field, court, or track. Optionally, it is contemplated that the first playing surface assembly can define a pitching mound, infield, or warning track of a baseball field.

Optionally, in exemplary aspects, the second playing surface assembly can comprise a backing, a plurality of artificial turf ribbons secured to and extending upwardly from the backing; and an infill material supported by the backing. In these aspects, it is contemplated that each artificial turf ribbon of the plurality of artificial turf ribbons can have a top end and a reveal distance corresponding to a vertical spacing between a top surface of the infill material and the top end of the artificial turf ribbon. Optionally, it is further contemplated that the reveal distance of each artificial turf ribbon of the second playing surface assembly can be at least 0.75 inches. Optionally, it is still further contemplated that a ratio between the reveal distance of the artificial turf ribbons and the height 42 of the infill material is greater than 0.3, and more preferably greater than 0.4 or greater than 0.5. Thus, it is contemplated that the first playing surface assembly 10*a* can cooperate with more traditional artificial turf constructions to define a playing surface 100. Additionally, or alternatively, the playing surface 100 can further include at least one natural grass/natural turf region.

Additionally, or alternatively, in further exemplary aspects, the playing surface 100 can be formed from a plurality of surface assemblies having a structure consistent with the playing surface assembly 10 disclosed herein. For example, as shown in FIG. 2, a baseball field (playing surface 100) can be formed by a first playing surface assembly 10*a* (corresponding to a first infield area), a second playing surface assembly 10*b* (corresponding to a pitching mound), a third playing surface assembly 10*c* (corresponding to a second infield area that defines the base paths), a fourth playing surface assembly 10*d* (corresponding to an outfield), and a fifth playing surface assembly 10*e* (corresponding to a warning track). Optionally, in this example, it is contemplated that the second, third, and fifth playing surface assemblies 10*b*, 10*c*, and 10*e* can have a structure with a plurality of reinforcement members as disclosed above with reference to FIG. 1. It is further contemplated that the first and fourth playing surface assemblies 10*a*, 10*d*, which correspond to grassed areas in a natural field, can have a more conventional artificial turf construction with a ratio between the reveal distance of the artificial turf ribbons and the height of the infill material being greater than 0.3, and more preferably greater than 0.4 or greater than 0.5 (and, optionally, less than 0.7 or less than 0.6).

Optionally, in some exemplary embodiments of the playing surface, at least one playing surface assembly (e.g., the second, third, and/or fifth playing surface assemblies disclosed above) can have an infill material that comprises clay, and portions of each reinforcement element of the first playing surface assembly can extend above the infill material of the first playing surface assembly and have a color that matches or substantially matches a color of the infill material. In some aspects, it is contemplated that natural infills (e.g., clay) can match fiber color more closely than black rubber crumb and other artificial infill materials.

In use, it is contemplated that the disclosed playing surface assemblies can be used to define at least a portion of a playing surface as further disclosed herein. Optionally, in exemplary aspects, the method can comprise modifying one or more properties of the infill material of the playing surface assembly to adjust one or more playing characteristics of the playing surface assembly (and the playing surface defined by the playing surface assembly). Optionally, in further exemplary aspects, the method can comprise watering the playing surface assembly to adjust one or more playing characteristics of the playing surface assembly.

It is contemplated that the disclosed playing surface assemblies can be made using any suitable method. When the plurality of reinforcement members are tufted into a woven backing, it is contemplated that the tufts can be formed using conventional methods for tufting artificial turf as are known in the art.

When the backing is a non-woven backing, the backing can be a three dimensional (3D) substrate that supports the plurality of reinforcement members in an upright position, provides proper footing and impact attenuation, and drainage. Optionally, such three dimensional substrates can be formed by gravitationally laid staple fibers into a nonwoven substrate in the manner disclosed in U.S. Provisional Patent Application No. 62/723,650, filed on Aug. 28, 2018, and U.S. Nonprovisional patent application Ser. No. 16/553,973, filed on Aug. 28, 2019, which are incorporated herein by reference in their entireties. Additional details of the formation of these three-dimensional substrates are provided below in the "Three-Dimensional Substrates" section of this application.

As further disclosed herein, it is contemplated that the disclosed playing surface assemblies can provide for improved playability compared to a variety of areas in natural fields, including, for example and without limitation, clay infield areas, which typically play hard and fast with no bounciness or squishiness, and warning track areas, which typically are displaceable, loud, hard, and loose (with no traction). It is further contemplated that the disclosed playing surface assemblies can provide improved safety by reducing postural issues and body fatigue related to rubber crumb squishiness and by configuring the warning track to alert players of potential collisions (or more generally, to a significant change in interaction with the player). It is still further contemplated that the disclosed playing surface assemblies can permit selective, precise tuning of the performance and play characteristics of the playing surface assemblies by modifying the infill properties, thereby dictating whether the playing surface plays "fast" or "slow" in the manner of real/natural fields. Optionally, it is contemplated that the disclosed playing surface assemblies can permit modification of the infill properties without the need for modifying the structure and properties of the underlying portions of the playing surface assemblies, including the reinforcement elements and the backing layer(s).

Performance Metrics

Optionally, the disclosed playing surface can have specific performance metrics. The performance metrics can be measurable with respect to measurement procedures set or followed by various standardized tests, as further disclosed herein. In exemplary aspects, a playability assessment tool can measure the performance metrics as disclosed herein. Embodiments of such a playablity assessment tool are described in copending U.S. patent application Ser. No. 16/563,684 to Philipe Aldahir, filed Sep. 6, 2019, which is hereby incorporated by reference herein in its entirety.

The following table includes exemplary performance characteristics of traditional artificial turf products, as well as exemplary performance characteristics of grass and clay-simulating playing surface assemblies as disclosed herein.

| Test | Unit | Detail | Traditional artificial turf Range | Grass-simulating Artificial turf (using the playability assessment tool) Range | Clay-simulating Artificial Turf Range |
|---|---|---|---|---|---|
| gmax | — | measures surface impact attenuation | <165 | 90-115 | 120-250 |
| HIC | — | measures surface impact attenuation | NA | 400-900 | 800-1500 |
| FR | % | measures surface impact attenuation | NA | 54-62 | 10-50 |

-continued

| Test | Unit | Detail | Traditional artificial turf Range | Grass-simulating Artificial turf (using the playability assessment tool) Range | Clay-simulating Artificial Turf Range |
|---|---|---|---|---|---|
| Vertical deformation | mm | measures firmness of surface | <11 | 5-10 | 2-5 |
| Energy restitution | % | measures surface rebound effect | NA | 15-35 | 10-50 |
| Shear vane | Nm | measures surface stability | NA | 8-15 | 4-9 |
| Rotational traction | Nm | measures torque to release cleats from surface. | 27-48 | 35-45 | 35-100 |

Optionally, at least a portion of the playing surface (e.g., the third playing surface assembly 10*c*, corresponding to a second infield area that defines the base paths, or the fifth playing surface assembly 10*e*, corresponding to a warning track) can have a gmax, measuring surface impact attenuation, that is between 120 and 250. (The gmax can be measured according to the procedure of ASTM F355A.) In further embodiments, the gmax of at least a portion of the playing surface (e.g., the third playing surface assembly 10*c* or the fifth playing surface assembly 10*e*) can be at least 180 (optionally, ranging from 180-250), at least 190 (optionally, ranging from 190-250), or at least 200 (optionally, ranging from 200-250). In some embodiments, the gmax of at least a portion of the playing surface can be between 165 and 250, or between at least 190 and 250. In further embodiments, the gmax of at least a portion of the playing surface (e.g., the first playing surface assembly 10*a*, corresponding to a first infield area) can be between 90 and 115. As should be understood, an infield or warning track having a gmax that is too low or close to the gmax of the grass portion can cause a less realistic feel, causing balls to bounce at incorrect trajectories (e.g., too high) or providing a warning track that is insufficiently different from the grass for a player to feel the change. Optionally, at least a portion of the playing surface can have a head injury criterion (HIC), measuring surface impact attenuation, between 800 and 1500. (The HIC can be measured according to the procedure of ASTM F355A.) In further embodiments, the HIC of at least a portion of the playing surface can be between 400 and 900. Optionally, at least a portion of the playing surface can have a force reduction (FR), measuring surface impact attenuation, between 54% and 62%. (The FR can be measured according to the procedure of ASTM F3189-17AAA.) In further embodiments, the FR of at least a portion of the playing surface can be between 10% and 50%. According to various aspects, at least a portion of the playing surface can have a vertical deformation, measuring the firmness of the surface, between 5 mm and 10 mm. (The vertical deformation can be measured according to the procedure of ASTM F3189-17AAA.) In further embodiments, the vertical deformation of at least a portion of the playing surface can be between 2 mm and 5 mm, or between 2 mm and 10 mm. Optionally, at least a portion of the playing surface can have an energy restitution, measuring surface rebound effect, between 15% and 35%. (The energy restitution can be measured according to the procedure of ASTM F3189-17AAA.) In further embodiments, the energy restitution of at least a portion of the playing surface can be between 10% and 15%, between 15% and 50%, or between 10% and 50%. Optionally, at least a portion of the playing surface can have a shear vane, measuring the surfacing stability, between 8 N-m and 15 N-m. (The shear vane can be measured according to the procedure of ASTM D8121/D8121M.) In further embodiments, the shear vane of at least a portion of the playing surface can be between 4 N-m and 9 N-m, between 4 N-m and 8 N-m, between 8 N-m and 15 N-m. Optionally, at least a portion of the playing surface can have a rotational traction, which can characterize the torque required to release cleats from the playing surface, between about 35 N-m and 45 N-m. (The rotational traction can be measured according to the procedure of ASTM F2333.) In further embodiments, the rotational traction of at least a portion of the playing surface can be between 35 N-m and 100 N-m or between 50 and 100 N-m. In still further embodiments, the rotational traction of at least a portion of the playing surface (e.g., the third playing surface assembly 10*c*, corresponding to a second infield area that defines the base paths, or the fifth playing surface assembly 10*e*, corresponding to a warning track) can be at least 60 N-m (optionally, between 60 N-m and 100 N-m), at least 70 N-m (optionally, between 70 N-m and 100 N-m), or at least 80 N-m (optionally, between 80 N-m and 100 N-m).

According to some embodiments, a first portion of the playing surface (e.g., the first playing surface assembly 10*a*, corresponding to a first infield area) can have a gmax between 90 and 115, an HIC between 400 and 900, a FR between 54 and 62%, a vertical deformation between 5 and 10 mm, an energy restitution between 15 and 35%, a shear vane between 8 and 15 N-m, and a rotational traction of between 27 and 48 N-m. In some embodiments, a second portion of the playing surface (e.g., the third playing surface assembly 10*c*, corresponding to a second infield area that defines the base paths) can have a gmax between 120 and 250, an HIC between 800 and 1500, a FR between 10 and 50%, a vertical deformation between 2 and 5 mm, an energy restitution between 10 and 50%, a shear vane between 4 and 9 N-m, and a rotational traction of between 35 and 100 N-m.

Playability Assessment Tool

Optionally, a playability assessment tool can measure certain performance properties of playing surfaces as disclosed herein. The playability assessment tool can determine a quantifiable playability score for fields (e.g., sports fields, surfaces or turf). The playability of a field, or sports surface, relates to the way in which objects and players interact with the surface. Various factors, including the surface hardness, stability, strength, moisture, composition, and other factors can affect the overall playability of a surface.

To determine a quantifiable playability score for a field, various tests can be performed at multiple points on the field. For example, tests for g-max, head injury criterion (HIC), Advanced Artificial Athlete (AAA) (e.g., vertical deformation, force reduction and energy restitution), shear vane, rotational traction, and/or other tests can be performed at various test points on the field. The tests results can be compiled in a test data matrix, with a first dimension representing each type of test and a second dimension for each test site (e.g., a row for each test site, with a column value for each type of test). A centroid associated with the test data matrix can be determined. For example, a clustering algorithm can be applied to one or more rows of the test data matrix to determine a centroid in multidimensional space. One or more distances (e.g., from the one or more rows of the test data matrix) to the centroid can be determined. Based on the determined distances, a playability score can be determined. For example, the determined distances can be compared to a reference data set (e.g., determined distances for another field, targeted or "goal" values). The playability score can then be determined based on a statistical difference between the determined distances and the reference data set. These quantified playability scores can then be used to evaluate and compare one field to another, or to an arbitrary "ideal target," and to determine if a field meets goals for overall playability.

In an exemplary aspect, the methods and systems can be implemented on a computer. Similarly, the methods and systems disclosed can utilize one or more computers to perform one or more functions in one or more locations.

The present methods and systems can be operational with numerous other general purpose or special purpose computing system environments or configurations. Examples of well-known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

According to an exemplary method, a test data matrix can be generated. The test data matrix can comprise a first dimension with each entry in the first dimension corresponding to a respective tested attribute. For example, each column of the test data matrix can correspond to a different attribute tested at a particular test site. The tested attributes can include, for example, an infill depth, g-max, head injury criterion (HIC), force reduction, vertical deformation, energy restitution, shear vane, rotational traction, moisture content, surface firmness, temperature, bounce and pace, strength to penetration, or other attribute as tested at the particular test site. The test data matrix can comprise a second dimension with each entry in the second dimension corresponding to a different test site. For example, given N tested attributes at M different test sites of a particular field over R repetitions per location, the test data matrix can comprise an (R*M)×N matrix. The particular test sites can vary based on a particular sport, division, material, or other aspect associated with the field. As the number of test sites M and/or the number of repetitions increases, the fidelity and precision of the resulting playability score increases.

Generating the test data matrix can also include generating additional entries for a particular dimension (e.g., the second dimension). For example, one or more additional rows can be generated. Generating the one or more additional rows can comprise generating the one or more additional rows as a function of one or more Cartesian cross products of the test data matrix. The one or more Cartesian cross products can include one or more random Cartesian cross products. The one or more additional rows can then be added to the test data matrix.

Next, a sample set can be determined. For example, the sample set can comprise the entirety of the test data matrix (e.g., the test data matrix and any generated additional rows, if any) or a combination of test data matrices. As another example, the sample set can comprise a subset of the test data matrix. The sample set can comprise a random selection of one or more entries (e.g., one or more rows) from the test data matrix. The size of the random selection can comprise a predetermined number of selected entries, a percentage of the total number of rows of the matrix, or another size. Determining the sample set can include scaling each value in the sample set. Scaling the sample set can include determining a minimum value and maximum value for each tested attribute. The minimum value for each tested attribute can be scaled to 0, and the maximum value can be scaled to 1. Each value for each tested value can be scaled according to their percentage of their corresponding maximum value. For example, a value that is seventy-five percent of the maximum value for its tested attribute can be scaled to 0.75. By scaling the values, test result values of varying magnitudes can be more easily compared, e.g., comparing a gmax value to an HIC value.

Next, a centroid associated with the test data matrix can be determined. For example, a centroid of the sample set can be determined. Determining the centroid can comprise applying one or more clustering algorithms to the sample set. The clustering algorithms can include a k-means clustering, a density-based spatial clustering of applications with noise (DBSCAN), a principal component analysis (PCA) clustering, and/or another clustering algorithm.

Next, a plurality of differences relative to the centroid can be determined. For example, assuming a sample set of M' rows of N columns, the centroid can comprise a point in N dimension space described as a 1×N matrix. Additionally, each row in the sample set can be described as a 1×N matrix. Thus, determining the plurality of differences can comprise determining M' differences for each row of the sample set relative to the centroid. Determining a distance for a given row to the centroid can comprise determining a cosine distance, a Euclidian distance, or another distance.

Next, a playability score can be determined for the field based on the determined plurality of distances. For example, the playability score can be determined as a function of a comparison to a reference data set. The reference data set can comprise, for example, one or more values associated with an "ideal" reference field, one or more industry standard values, or another value. For example, the playability score can be determined as a difference or deviation calculated as a function of t-testing or another statistical analysis.

Assuming the following test values, a final playability score of 99 is achieved relative to a reference data set.

| Test | Actual | Scaled (Plot) | Final Score |
|---|---|---|---|
| Gmax | 99.94 | 0.95 | 99 |
| HIC | 618.88 | 0.97 | |
| Force Reduction | 56.42 | 0.90 | |
| Vertical Deformation | 6.45 | 0.93 | |
| Energy Restitution | 23.59 | 0.96 | |
| Shear Vane | 11.08 | 0.97 | |
| Rotational Traction | 38.15 | 0.91 | |

Assuming the following test values, a final playability score of 68 can be achieved relative to a reference data set.

| Test | Actual | Scaled (Plot) | Final Score |
|---|---|---|---|
| Gmax | 77.18 | 0.49 | 68 |
| HIC | 489.32 | 0.84 | |
| Force Reduction | 45.18 | 0.20 | |
| Vertical Deformation | 5.29 | 0.79 | |
| Energy Restitution | 19.91 | 0.87 | |
| Shear Vane | 8.64 | 0.80 | |
| Rotational Traction | 30.07 | 0.50 | |

Assuming the following test values, a final playability score of 16 can be achieved relative to a reference data set.

| Test | Actual | Scaled (Plot) | Final Score |
|---|---|---|---|
| Gmax | 55.38 | 0.06 | 16 |
| HIC | 357.56 | 0.71 | |
| Force Reduction | 42 | 0.0 | |
| Vertical Deformation | 3.87 | 0.61 | |
| Energy Restitution | 13.05 | 0.70 | |
| Shear Vane | 5.8 | 0.59 | |
| Rotational Traction | 21.57 | 0.08 | |

Three-Dimensional Substrates

In certain aspects, disclosed herein are various backing layers that can be used to replace conventional woven fabrics. In certain aspects, these conventional woven fabrics that commonly used as a primary backing are replaced by 3D structures that can support the grass fibers in an upright position. In certain aspects, the backing layers of the playing surface assemblies described herein, can provide proper footing and impact attenuation, drainage, and potentially even eliminate the need for constructing a drainage sub-base below the artificial turf. In certain aspects, such layers can comprise a nonwoven batt, a spaghetti-mat type structure, open cell foams, wiry rigid structures, etc.

An exemplary playing surface assembly can comprise: a nonwoven backing layer having a face side and a back side, and a plurality of fibers extending through the nonwoven backing layer such that a face side portion of the fibers extends from the face side of the nonwoven backing layer and a back side portion of the fibers extends from the back side of the nonwoven backing layer, wherein at least a portion of the back side portion of fibers are bonded to themselves.

In certain aspects, the nonwoven backing layer comprises a fiber batt. In certain aspects, the fiber batt can be formed from gravitationally laid fibers. In still further aspects, the fiber batt comprises fibers that are mechanically bonded. In yet other aspects, the fiber batt comprises fibers that are thermally bonded. In certain aspects, the batt can be formed by gravitationally laying the fibers and mechanically interlocking the fibers. In still further aspects, the batt is semi-permeable. In still further aspects, the batt is impermeable. In certain aspects, the nonwoven backing layer is needlepunched.

In yet other aspects, the nonwoven backing layer can be further compressed to achieve a predetermined strength, density, and resilience. It is understood that one of ordinary skill in the art would determine a specific strength, density, and resilience of the nonwoven backing layer depending on the desired application. In certain exemplary aspects, the fabric strength of 150 lbs in each direction (warp/weft) can be required to produce a playing surface assembly useful in sports applications.

In still further aspects, the nonwoven backing layer is substantially homogeneous. In still further aspects, the nonwoven backing layer is homogenous. In still further aspects, the nonwoven backing layer is substantially uniform. In some aspects, the backing layer is heterogeneous. In still further aspects, the backing structure can be layered. In some aspects, the backing layer comprises one or more layers. In still further aspects, each of the layers can comprise the same or a different material. In still further aspects, each of the layers can have the same or a different density. In still further aspects, the backing layers can be porous.

In still further aspects, the nonwoven backing layer can comprise one or more fiber batt layers. In still further aspects, if more than one fiber batt is present, each of the present fiber batts can have the same or a different thickness. In yet other aspects, if more than one fiber batt is present, each of the present batts can have the same or a different density. In still further aspects, if more than one fiber batt is present in the nonwoven backing layer, the fiber batts can differ from each other by a various set of characteristics. For example and without limitations, characteristics that can differ between the different fiber batts include one or more of: mass per unit area, a type of fiber, a fiber length, a fiber cross-sectional size, a fiber cross-sectional shape, a fiber tenacity, a fiber crimp, proportions of fibers of different polymer types, a fiber composition (including, but is not limited to, the polymer fiber vs natural fiber, a specific polymer type used in the composition, types and amounts of additives that can be optionally included in the composition to provide desirable characteristics), resistance to ultraviolet radiation, color, resilience (meaning springiness), a sheet orientation (e.g. a top-up or a bottom-up, where the top and bottom refer to the sides of the sheets when manufactured in a substantially horizontal configuration), a sheet thickness, a degree of entanglement of the polymer fibers and the like. In certain aspects, where more than one fiber batt is present in the nonwoven backing layer, the fibers batts can be mutually attached. In certain aspects, the fiber batts present in the nonwoven backing layer can be mutually attached by the entanglement of fibers of the different batts. In yet other aspects, the fiber batts present in the nonwoven backing layer can be mutually attached by the entanglement of fibers of the different batts using a needlepunch technology or any technology similar to that. In still further aspects, the fiber batts present in the nonwoven backing layer can be mutually attached by the entanglement of fibers of the different fiber batts using a hydro-entanglement technology or any technology similar to that. In still further aspects, the fiber batts present in the nonwoven backing layer can be mutually attached by the entanglement of fibers of the different batts using an air-laid technology or any technology similar to that. In yet other aspects, the fiber batts present in the nonwoven backing layer can be mutually attached by the entanglement of fibers of the different batts using a spunbonded technology or any technology similar to that. In yet other aspects, the fiber batts present in the nonwoven backing layer can be mutually attached by a process that includes heating. In still other aspects, the fiber batts present in the nonwoven backing layer can be mutually attached by a process that includes an application of pressure. In other aspects, the fiber batts present in the nonwoven backing layer can be mutually attached by a process that includes calendering.

In some aspects, the nonwoven backing layer does not comprise any additional binders or adhesives that are used to lock the fibers in the fiber batt. In such aspects, the terms "additional binders or adhesives" denote binders or adhesives which are not part of, or inherent in, the fibers of the fiber batt. In yet other aspects, the arrangement and contact of the fibers can lock the fibers in a specific position by mechanisms comprising a physical entangling of the fibers, friction between the fibers and/or an inherent bonding of fibers. In such aspects, the term "inherent bonding of fibers" denotes bonding, which relies upon the properties of the fibers, rather than on an additional bonding or a presence of binding materials. For example, and without limitation, the adhesion between fibers can be regarded as being an inherent bonding if they adhere due to a heat (and/or pressure) treatment, which allows them to adhere together due to the properties of the fibers; but it should not be regarded as being bonded by inherent bonding of the fibers if they are adhered by a resin or other bonding materials, which are not part of the fibers. It should be regarded that contact between fibers is intended to include contact at regions where fibers are fused or welded together, so that fused or welded (but still distinguishable) fibers are considered to have contact therebetween.

In certain aspects, the fiber batt can be formed by utilizing a card and cross lapping system, an airlay system, or a combination thereof. In still further aspects, the fiber batt can be formed by calendering. It is understood that in some aspects, after the fibers are gravitationally laid, the formed fiber batt can further be needlepunched. In still further aspects, the formed fiber batt can further be heat and pressure treated to further densify the batt.

In yet other aspects, the nonwoven backing layer can comprise any fibers known in the art. In certain aspects, the fibers are polymeric fibers. In yet other aspects, the fibers are natural fibers. In still other aspects, the fibers are biodegradable fibers. In yet certain aspects, the fibers are degradable fibers. In still further aspects, the fibers can comprise polyester fibers, polyolefin fibers, polyamide fibers, polyurethane fibers, acrylic fibers, or any other fibers known in the art. In some aspects, the nonwoven backing material is comprised of the fibers comprising at least one of nylon, polyester, polyethylene, and polypropylene, cotton, Kenaf, jute, or any combination thereof.

In aspects, where the fiber comprises nylon, it is understood that the conventional nylon fibers, for example, and without limitation, comprise one or more of nylon 6/6 fibers, nylon 6 fibers, nylon 10 fibers, nylon 10/10 fibers, nylon 10/11 fibers, or nylon 11 fibers, and the like. In aspects, where the fiber comprises polyester, it is understood that the conventional polyester fiber, for example, and without limitation, comprises one or more of polyethylene terephthalate (PET) fiber, polypropylene terephthalate (PPT) fiber, polybutylene terephthalate (PBT) fiber, or polytrimethylene terephthalate (PTT) fiber.

In still further aspects, the nonwoven backing layer can comprise various blends of fibers. In some aspects, the fibers present in the nonwoven backing layer can have the same or a different melting point. In certain aspects, the nonwoven backing layer can comprise low-melt fibers and high-melt fibers. It is understood that as used herein, the low-melt fibers define fibers having a melting point between about 100° C. and about 180° C. In certain aspects, the melting point of the low-melt fiber is about 110° C., about 120° C., about 130° C., about 140° C., about 150° C., about 160° C., or about 170° C.

In yet other aspects, the low-melt fiber can comprise, for example, and without limitation, a low-melt polyester, polypropylene, polyethylene, co-polyester, copolymer nylons, engineered olefins, conjugate filament-linear low-density polyethylene, acrylics, low-melt nylon, and the like. As one of ordinary skill in the pertinent art will appreciate, if the nonwoven backing layer is heated to thermally bond the fibers, the heating of the low-melt fiber in the disclosed nonwoven backing layer can create globules of the low-melt polymer at the crossover points where the fibers intersect.

In yet other aspects, the low-melt fibers present in the nonwoven backing layer can comprise a bi-component fiber having a portion of a high- or a standard-melt material and a portion of a low-melt polymer. In such aspects, the bi-component fiber configuration can be, for example, and without limitation, islands-in-the-sea, side-by-side, core-sheath, and the like. As one of ordinary skill in the pertinent art will appreciate, the bi-component fibers can maintain their original structural integrity while also allowing each fiber to glue itself to the adjacent fibers. It is contemplated that any known materials having appropriate melt characteristics can be used to form the bi-component fibers.

It is further understood that both the virgin and the post-consumer or the post-industrial fibers can be used. In aspects, where the post-consumer or post-industrial fibers are used, the fibers can be obtained from any textiles known in the art. In certain aspects, the fibers are obtained from the post-consumer or post-industrial carpets, carpet tiles, or artificial turfs. According to aspects of this invention, the fibers can be obtained from the various components of the prior manufactured carpet product, for example and without limitation, it can be obtained from a face layer, an adhesive layer, a backing layer, a secondary backing layer, an underlayment, a cushioning material, a reinforcing layer, or a scrim, or any combination thereof. In still further aspects, the fiber used in the inventive nonwoven backing can comprise a mixture of the virgin and recycled fibers. In some aspects, the recycled fibers can be present in any amount from 0 wt % to 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, and about 90 wt %. It is further understood that any of the mentioned materials can undergo multiple recycling cycles prior to the use in the disclosed nonwoven backing layers.

In still further aspects, the fibers of the inventive fiber batt can comprise any type of fibers. In some aspects, the fibers are tape fibers. In still further aspects, the fibers are slit film fibers. In yet other aspects, the fibers are spun fibers. In still further aspects, the fiber batt can comprise air entangled yarns.

According to certain aspects, the fibers present in the nonwoven backing layer can exhibit a substantially uniform size, including a substantially uniform linear density measured in denier units and substantially uniform fiber lengths. However, in alternative aspects, the fibers present in the nonwoven backing layer can have non-uniform linear densities and non-uniform fiber lengths. In certain aspects, the nonwoven backing layer is comprised of the fibers having a length from about 1 to about 8 inches, including exemplary values of about 1.2 inches, about 1.5 inches, about 1.8 inches, about 2 inches, about 2.2 inches, about 2.5 inches, about 2.8 inches, about 3 inches, about 3.2 inches, about 3.5 inches, about 3.8 inches, about 4.0 inches, about 4.2 inches, about 4.5 inches, about 4.8 inches, about 5 inches, about 5.2 inches, about 5.5 inches, about 5.8 inches, about 6 inches, about 6.2 inches, about 6.5 inches, about 6.8 inches, about 7 inches, about 7.2 inches, about 7.5 inches, and about 7.8 inches. In still further aspects, the fiber lengths can have any value between any two foregoing length values.

As can be understood by one of ordinary skill in the art and as discussed herein, the backing layers of the current invention can also comprise various meshes, foams, elastic structures, and the like. In such aspects, the fibers can comprise plastic materials or metal materials. In certain aspects, the backing layers can also comprise wires.

In still further aspects, wherein the backing layer is the nonwoven backing layer, this nonwoven backing layer can be comprised of the fibers having a denier ranging between about 2 to less than about 20,000 denier per filament (DPF), including exemplary values of about 10 DPF, about 50 DPF, about 100 DPF, about 200 DPF, about 500 DPF, about 800 DPF, about 1,000 DPF, about 1,500 DPF, about 2,000 DPF, about 2,500 DPF, about 3,000 DPF, about 3,500 DPF, about 4,000 DPF, about 4,500 DPF, about 5,000 DPF, about 5,500 DPF, about 6,000 DPF, about 6,500 DPF, about 7,000 DPF, about 7,500 DPF, about 8,000 DPF, about 8,500 DPF, about 9,000 DPF, about 9,500 DPF, about 10,000 DPF, about 10,500 DPF, about 11,000 DPF, about 11,500 DPF, about 12,000 DPF, about 12,500 DPF, about 13,000 DPF, about 13,500 DPF, about 14,000 DPF, about 14,500 DPF, about 15,000 DPF, about 15,500 DPF, about 16,000 DPF, about 16,500 DPF, about 17,000 DPF, about 17,500 DPF, about 18,000 DPF, about 18,500 DPF, about 19,000 DPF, about 19,500 DPF, and less than 20,000 DPF. In still further aspects, the fibers can have any denier value between any two foregoing denier values.

In still further aspects, the nonwoven backing layer can comprise polymeric fibers having a length from about 1 to about 4 inches and a denier ranging between about 2 DPF to less than about 20,000 DPF. In still any further aspects, the nonwoven backing layer is comprised of the fibers having a length from about 1 to about 4 inches and a denier ranging between about 2 to about 1,000 DPF.

In still further aspects, the nonwoven backing can further comprise at least one additive material distributed therein. In certain aspects, the at least one additive material comprises at least one of rubber crumbs, wood chips, sand, grass seeds, foam chips, and an inorganic filler. In certain aspects, the inorganic fillers can be any suitable fillers, including, for example, aluminum oxide trihydrate (alumina), calcium carbonate, barium sulfate, or mixtures thereof. The fillers can comprise a virgin filler, a waste material, or even reclaimed fillers. Examples of recycled fillers include coal fly ash and calcium carbonate.

It is understood that the additives can comprise virgin and/or recycled materials. In some aspects, the recycled material can be present in any amount from 0 wt % to 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, and about 90 wt %.

In still further aspects, the nonwoven backing layer can further comprise any additives, coatings, or waste materials that are known in the art. In certain aspects, the nonwoven backing layer can also comprise an amount of infill materials commonly used in turf. In such exemplary aspects, the reclaimed materials can comprise an amount of silica sand, rubber granules, organic components, dirt, any combination thereof, and the like.

In still further aspects, when more cushioning is required for the specific playing surface applications, the nonwoven backing layer can be a cushion backing layer. In some aspects, wherein the nonwoven backing layer is a cushion backing layer, the nonwoven backing layer exhibits a maximum compression set of about 25% as measured according to ASTM D1617 standard, including exemplary values of about 5%, about 10%, about 15%, and about 20%.

In certain aspects, the nonwoven backing layer can have a thickness between about 1/16 inch to about 2.5 inches, including exemplary values of about 1/8 inch, about 1/4 inch, about 1/2 inch, about 3/4 inch, about 1 inch, about 1.2 inch, about 1.5 inch, about 1.7 inch, about 2 inch, about 2.2 inch, and about 2.4 inch. It is understood that the nonwoven backing layer can have any thickness value between any foregoing values.

In yet other aspects, the nonwoven backing layer can have a density from about 3 lbs/ft$^3$ to about 30 lbs/ft$^3$, including exemplary values of about 4 lbs/ft$^3$, about 5 lbs/ft$^3$, about 6 lbs/ft$^3$, about 7 lbs/ft$^3$, about 8 lbs/ft$^3$, about 9 lbs/ft$^3$, about 10 lbs/ft$^3$, about 11 lbs/ft$^3$, about 12 lbs/ft$^3$, about 13 lbs/ft$^3$, about 14 lbs/ft$^3$, about 15 lbs/ft$^3$, about 16 lbs/ft$^3$, about 17 lbs/ft$^3$, about 18 lbs/ft$^3$, about 19 lbs/ft$^3$, about 20 lbs/ft$^3$, about 21 lbs/ft$^3$, about 22 lbs/ft$^3$, about 23 lbs/ft$^3$, about 24 lbs/ft$^3$, about 25 lbs/ft$^3$, about 26 lbs/ft$^3$, about 27 lbs/ft$^3$, about 28 lbs/ft$^3$, and about 29 lbs/ft$^3$. In still further aspects, the nonwoven backing layer can have any density value between any foregoing values. For example and without limitation, the nonwoven backing layer can have a density between 4 lbs/ft$^3$ to 7 lbs/ft$^3$, between 8 lbs/ft$^3$ to 10 lbs/ft$^3$, between 10 lbs/ft$^3$ to 17 lbs/ft$^3$, or between 18 lbs/ft$^3$ to 30 lbs/ft$^3$.

In still further aspects, the nonwoven backing layer can have a thickness from about 1/16 inch to about 2.5 inches and a density from about 3 lbs/ft$^3$ to about 30 lbs/ft$^3$.

In still further aspects, the nonwoven backing layer can be further capped with a mesh, scrim, or felt. The mesh, scrim, or felt can be optionally added to either the face side and/or the back side of the nonwoven backing layer. In still further aspects, the artificial turf can further comprise a secondary backing. In such aspects, the secondary backing can be attached to the nonwoven backing layer to either the face side and/or the back side of the nonwoven backing layer. In yet other aspects, the secondary backing can be attached by any methods known in the art, including, for example, through the coating, lamination, extrusion, and the like.

In certain aspects, the secondary backing can comprise various layers and coatings. Such exemplary backings can comprise extruded polymer sheets, laminated films, calendered hot melts and glues, latex, crosslinked polyurethanes, woven layer(s), meshes and scrims, or any combination thereof. In still further aspects, the secondary backing can comprise a film that can be laminated to the back side of the nonwoven backing layer to thermobond the turf fibers to themselves.

In some aspects, the disclosed nonwoven backings can be used for different applications. In certain aspects, the nonwoven backings can provide a 3D matrix that anchors reinforcement or artificial grass fibers or yarns as further disclosed herein. In some aspects, the disclosed nonwoven backings can be used on their own, even without the presence of the reinforcement or artificial grass fibers or yarns. In some aspects, the disclosed nonwoven backings can be used in hybrid turfs. In such aspects, natural grass can be grown within the nonwoven backings to be provided along with artificial grass. In still further aspects, the disclosed nonwoven backings can be used for soil stabilization and erosion control in various areas. In still other aspects, the nonwoven backings as disclosed herein can enhance playability and performance of the turf, by, for example, providing cushion, a drainage layer.

As disclosed herein, the playing surface assemblies comprise a plurality of reinforcement or artificial turf fibers or yarns. In certain aspects, a plurality of fibers are gravitationally laid on the face side of the nonwoven backing layer, and subsequently, needlepunched through the fibers. In such aspects, wherein the plurality of fibers are added to the nonwoven backing layer, the denier of the fibers present in the nonwoven backing layer can be from about 2 denier to about less than 20,000 denier including exemplary values of about 10 denier, about 50 denier, about 100 denier, about 200 denier, about 500 denier, about 800 denier, about 1,000 denier, about 1,500 denier, about 2,000 denier, about 2,500 denier, about 3,000 denier, about 3,500 denier, about 4,000 denier, about 4,500 denier, about 5,000 denier, about 5,500 denier, about 6,000 denier, about 6,500 denier, about 7,000 denier, about 7,500 denier, about 8,000 denier, about 8,500 denier, about 9,000 denier, about 9,500 denier, about 10,000 denier, about 10,500 denier, about 11,000 denier, about 11,500 denier, about 12,000 denier, about 12,500 denier, about 13,000 denier, about 13,500 denier, about 14,000 denier, about 14,500 denier, about 15,000 denier, about 15,500 denier, about 16,000 denier, about 16,500 denier, about 17,000 denier, about 17,500 denier, about 18,000 denier, about 18,500 denier, about 19,000 denier, about 19,500 denier, and less than 20,000 denier. In still further aspects, the fibers can have any denier value between any two foregoing denier values. It is understood that in some exemplary aspects, a fiber can be characterized as a multifilament bundle. In still other exemplary aspects, the fiber can be characterized as a single filament.

It is understood that the plurality of fibers can comprise any fibers known in the art and conventionally utilized in the artificial turfs. In yet other aspects, the plurality of fibers comprise tufted fibers. In still further aspects, the plurality of fibers comprise staple fibers. In still further aspects, the plurality of fibers are comprised of slit film fibers, monofilaments, or texturized fibers.

In yet other aspects, the plurality of fibers present in the disclosed playing surface assemblies can have any length predetermined by one of ordinary skill in the art and based on the specific application. In still further aspects, the plurality of fibers can have a length from about 0.25 inches to about 6 inches, including exemplary values of about 0.5 inches, about 0.75 inches, about 1 inch, about 1.25 inches, about 1.5 inches, about 1.75 inches, about 2 inches, about 2.25 inches, about 2.5 inches, about 2.75 inches, about 3 inches, about 3.25 inches, about 3.5 inches, about 3.75 inches, about 4 inches, about 4.25 inches, about 4.5 inches, about 4.75 inches, about 5 inches, about 5.25 inches, about 5.5 inches, and about 5.75 inches. It is understood that the plurality of fibers can have any length value between any two foregoing values.

In still further aspects, the plurality of fibers present in the disclosed playing surface assemblies can have any denier predetermined by one of ordinary skill in the art and based on the specific application. In some aspects, the plurality of fibers can have a denier value from about 3 denier to about 20,000 denier, including exemplary values of about 5 denier, about 10 denier, about 20 denier, about 30 denier, about 40 denier, about 50 denier, about 60 denier, about 70 denier, about 80 denier, about 90 denier, about 100 denier, about 200 denier, about 300 denier, about 400 denier, about 500 denier, about 600 denier, about 700 denier, about 800 denier, about 900 denier, about 1,000 denier, about 1,500 denier, about 2,000 denier, about 2,500 denier, about 3,000 denier, about 3,500 denier, about 4,000 denier, about 4,500 denier, about 5,000 denier, about 5,500 denier, about 6,000 denier, about 6,500 denier, about 7,000 denier, about 7,500 denier, about 8,000 denier, about 8,500 denier, about 9,000 denier, about 9,500 denier, about 10,000 denier, about 10,500 denier, about 11,000 denier, about 11,500 denier, about 12,000 denier, about 12,500 denier, about 13,000 denier, about 13,500 denier, about 14,000 denier, about 14,500 denier, about 15,000 denier, about 15,500 denier, about 16,000 denier, about 16,500 denier, about 17,000 denier, about 17,500 denier, about 18,000 denier, about 18,500 denier, about 19,000 denier, about 19,500 denier, and less than 20,000 denier. In still further aspects, the fibers can have any denier value between any two foregoing denier values. For example and without limitation, in aspects where the slit film fibers are present, the fiber denier is from about 100 denier to about 15,000 denier. In yet other exemplary aspects, where the monofilament fibers are present, the fiber denier is from about 3 denier to about 3,000 denier. In certain exemplary aspects, the small denier fibers from about 3 denier to about 500 denier can act as binding fibers, to add cushion, or to provide support along the base of the slit film fibers to assist them in standing rather than laying over onto the nonwoven backing layer.

The plurality of fibers can comprise any material that is conventionally used in the artificial manufacturing, singly or in a combination with other such materials. For example, and without limitation, the plurality of fibers can be synthetic, such as, for example, a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polybutylene terephthalate (PBT), polytrimethylene terephthalate (PTT), or any combination thereof. In still further aspects, the plurality of fibers can comprise polymeric fibers comprising at least one of nylon, polyester, polyethylene, and polypropylene. In some exemplary aspects, the plurality of fibers can comprise one or more of the biodegradable materials, including, for example, and without limitation, polylactic acid (PLA). In still further aspects, the plurality of fibers can comprise a combination of any of the materials mentioned above.

In still further aspects, a portion of the back side fibers of the playing surface assemblies described herein can be bonded to themselves via an adhesive coating. In such aspects, the adhesive coating can be any adhesive coating known in the art. In certain aspects, the adhesive coating can comprise various polyolefin materials such as, for example and without limitation, ethylene acrylic acid (EAA), ethylene vinyl acetate (EVA), polypropylene or polyethylene (e.g., low density polyethylene (LDPE), linear low density polyethylene (LLDPE) or substantially linear ethylene polymer, or mixtures thereof). In some aspects, the adhesive coating can comprise latex. It is further contemplated that the adhesive coating can be selected from a group comprising, without limitation, an EVA hotmelt, a vinyl acetate ethylene (VAE) emulsion, carboxylated styrene-butadiene (XSB) latex copolymer, a styrene-butadiene resin (SBR) latex, a BDMMA latex, an acrylic latex, an acrylic copolymer, a styrene copolymer, butadiene acrylate copolymer, a polyolefin hotmelt, polyurethane and/or emulsions, and any combination thereof. In still further aspects, the precoat composition comprises latex. In yet other aspects, where the adhesive coating comprises the latex composition, the latex further comprises a carboxylated styrene-butadiene (XSB) latex copolymer, a styrene-butadiene resin (SBR) latex, a BDMMA latex, an acrylic latex, an acrylic copolymer, a styrene copolymer, or a combination thereof.

In still further aspects, a portion of the back side fibers of the disclosed playing surface assemblies can be bonded to themselves by mechanical bonding. In still further aspects, a portion of the back side turf fibers of the disclosed playing surface assemblies can be bonded to themselves by thermo-bonding.

In still further aspects, a portion of the back side portion of fibers is also bonded to the back side of the nonwoven backing layer. In still further aspects, the plurality of fibers and the nonwoven backing are each comprised of the same polymeric material. In still further aspects, the plurality of turf fibers and the nonwoven backing layer are each comprised of a different polymeric material.

The disclosed playing surface assemblies can optionally comprise a primary backing disposed between the plurality of fibers and the nonwoven backing layer.

In aspects where the primary backing is present, the primary backing comprises a polyolefin, a polyester, a polyamide, or a combination thereof. In such aspects, the primary backing can be woven and non-woven. In certain aspects, the primary backing can comprise non-woven webs, or spunbonded materials. In some aspects, the primary backing can comprise a combination of woven and non-woven materials. In some aspects, the primary backing comprises a polyolefin polymer. In other aspects, the polyolefin polymer comprises polypropylene. In yet other aspects, the primary backing is a slit film polypropylene sheet, such as that sold by Propex or Synthetic Industries owned by Shaw Industries. In yet further aspects, the primary backing can comprise polyester. In a still further aspect, the primary backing can comprise polyamide. In yet further aspects, the primary backing can comprise a combination of polyamide and polyester. In certain aspects, the polyamide is nylon. In some other aspects, the primary backing can comprise a woven polyethylene terephthalate (PET). In yet other aspects, the primary backing can comprise a woven PET having a post-consumer and/or a post-industrial content.

In certain aspects, the primary backing is a spun-bond primary backing. In some aspect, the spun-bond primary backing component can comprise a bi-component filament of a sheath-core type. In some aspects, the polymeric core component can have a higher melting point than the polymeric sheath component. In some aspects, the polymeric core component can comprise polyester, aliphatic polyamides, polyphenylene oxide and/or co-polymers or blends thereof. In yet other aspects, the polyester can comprise polyethylene terephthalate, polybutylene terephthalate, or polyparaphenylene terephthalamide. In yet other aspects, the polymeric core comprises polyethylene terephthalate. In further aspects, the sheath polymer can comprise a polyamide, polyethylene, or polyester. In yet further aspects, the sheath polymer comprises nylon. In still further aspects, the sheath-core primary backing component comprises polyester as a core component and nylon as a sheath component. The exemplary sheath-core primary backing is commercially available from Bonar. In yet other aspects, an exemplary polyester non-woven primary backing is commercially available from Freudenberg. In still further aspects, such a primary backing provides extra stability to the product.

In still further aspects, the disclosed playing surface assemblies can be permeable to moisture. In still further aspects, the disclosed playing surface assemblies can be fully recyclable.

In yet further aspects, the disclosed playing surface assemblies can be provided in any form known in the art. In some aspects, the playing surface assemblies can be provided in a form of panels. In such aspects, the panels can be installed in any selected orientation. In still further aspects, the disclosed playing surface assemblies (excluding filler materials) can have a continuous length and be rolled into a roll. In such aspects, the roll can be unrolled on the installation site.

The present disclosure further provides a method for manufacturing a playing surface assembly, comprising: inserting a plurality of fibers into a nonwoven backing layer having a face side and a back side such that the plurality of fibers extend through the nonwoven backing layer and a face side portion of the fibers extends from the face side of the nonwoven backing layer and a back side portion of the fibers extends from the back side of the backing layer; and bonding at least a portion of the back side portion of fibers to themselves.

In still further aspects, the nonwoven backing layer is a fiber batt comprised of the gravitationally laid fibers. In certain aspects, the gravitationally laying process can be done by utilizing a card and cross lapping system, an airlay system, or a combination thereof. In still further aspects, it can be done by calendering. In still further aspects, after the fibers are gravitationally laid, the fibers are mechanically bonded. In other aspects, after the fibers are gravitationally laid, the fibers are thermally bonded. Any methods of the mechanical and thermal bonding can be utilized to bond the gravitationally laid fibers of the nonwoven backing layer. In still further aspects, the nonwoven backing layer is needlepunched. In yet other aspects, the nonwoven backing can be further heat and pressure treated to form the nonwoven backing having a predetermined density.

It is understood that the nonwoven backing layer prepared by the disclosed methods can be comprised of any fibers described herein. In some aspects, the nonwoven backing layer can comprise at least one of nylon, polyester, polyethylene, and polypropylene, cotton, Kenaf, jute, or any combination thereof.

In yet other aspects, the nonwoven backing layer prepared by the disclosed methods can comprise fibers having any length or denier described in details above.

In still further aspects, the nonwoven backing layer can have at least one additive material distributed within the nonwoven backing layer. The distribution of the additive materials can be done by any methods known in the art and at any step of making the inventive artificial turf. At least one additive material distributed within the nonwoven backing layer can comprise any of the materials described in details above. In some exemplary aspects, at least one additive material comprises at least one of rubber crumbs, wood chips, sand, grass seeds, and inorganic fillers.

In still further aspects, the nonwoven backing layer can be formed into the cushion. It is understood that the nonwoven backing layers can have any thickness and density described in details above.

In yet other aspects, the plurality of fibers present in the disclosed playing surface assemblies can be inserted into the nonwoven backing by a process that comprises gravitationally laying the fibers on the face side of the nonwoven backing and needlepunching the gravitationally laid fibers into the nonwoven backing. Similarly, the process of gravitationally laying the fibers can comprise a card and cross-lapping system, an airlay system, or a combination thereof.

In some aspects, the plurality of fibers can be inserted into the nonwoven backing layer by tufting. Any conventional tufting apparatus can be used to insert the plurality of fibers into the nonwoven backing layer. In some aspects, to improve the tufting process, longer spikes on the spike-roller to grab the nonwoven fully can be utilized. In yet other aspects, a "carrier" fabric, mesh, or layer can be provided to the nonwoven backing layer to facilitate pulling it through the process.

In still further aspects, the step of bonding at least a portion of the back side portion of fibers to themselves comprises applying an adhesive coating. It is understood that any adhesive material described herein can be applied. It is further understood that any known in the art methods of applying the adhesive material can be utilized. In some exemplary aspects, the adhesive material can be applied by spray, by powder scattering, as a hot melt, by extrusion, lamination, and the like.

In still further aspects, the step of bonding at least a portion of the back side portion of fibers to themselves comprises a mechanical bonding. In exemplary aspects, the mechanical bonding is provided by needlepunching. In yet other aspects, the mechanical bonding can comprise a source of high-pressure air and/or water. In these aspects, the source of high-pressure air and/or water can provide jets of air and/or water having sufficient energy to move filaments from the fibers so as to have stray filaments pushed into adjacent filaments to make fibrous mechanical connections. In further aspects, the mechanical bonding can comprise threads that can be sewn into the edges to secure the fibers/filaments. In even further aspects, the mechanical bonding can comprise ultrasonic pins to secure the edge fibers/filaments. In other aspects, the mechanical bonding can comprise mechanical combing of the fibers/filaments. In other aspects, mechanical bonding can comprise vacuum combing behind the edge fibers/filaments. In further aspects, the mechanical bonding can comprise hot air jets. In these aspects, the hot air jets can be used to move and fuse the edge fibers/filaments.

In yet other aspects, the step of bonding at least a portion of the back side portion of fibers to themselves comprises a thermobonding. In some exemplary aspects, the thermobonding can comprise a heated rod and/or a heated shoe. In these aspects, the heated rod and/or heated shoe can be used to heat fuse the edge fibers/filaments.

In some exemplary aspects, lamination can be utilized to thermobond the fibers to themselves. In certain aspects, a film having a thickness of about 1 mil to about 10 mil, including exemplary values of about 2 mil, about 3 mil, bout 4 mil, about 5 mil, about 6 mil, about 7 mil, about 8 mil, and about 9 mil, can be laminated to the back surface of the nonwoven backing layer to thermobond the fibers to themselves. In certain aspects, the playing surface assembly can be fed through a film laminator without adding any additional films to ensure the thermobonding of the fibers to themselves. In still further aspects, the method described herein further comprises bonding at least a portion of the back side portion of fibers to the back side of the nonwoven backing layer.

In still further aspects, the playing surface assembly prepared by methods disclosed herein can be permeable to moisture.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary and are not intended to limit the disclosure. Efforts have been made to ensure accuracy with respect to numbers (e.g., amounts, temperature, etc.), but some errors and deviations should be accounted for. Unless indicated otherwise, parts are parts by weight, temperature is in ° F. or is at ambient temperature, and pressure is at or near atmospheric.

Samples have been prepared to evaluate technical capabilities for tufting into an exemplary nonwoven backing layer as described herein. Width of the nonwoven material was 150¾ inch at unwind, 149⅜ inch at the tufting bar, and 149½ inch at mending. Needle penetration, needle travel and clearance, tufting speed, and integrity of tufting bar have been evaluated. No undesirable behavior was observed for the needle penetration and travel, and integrity of the tufting bar throughout the process at a maximum tufting speed of 302 RPMs. In an exemplary tufted artificial turf, a tufting machine can produce an artificial turf having a plurality of turf fibers tufted directly into the nonwoven backing layer without the use of the conventional woven primary backing material.

The woven primary backing is not required and can be used as an optional layer. In some examples, it was found that a dissimilar tension that can be present between the woven and nonwoven backing can result in undesirable wrinkles. It was also shown that the pile height loss of the inventive artificial turf that does not comprise a primary backing, due to a thickness of the nonwoven backing layer, was about 6/32 inch.

Exemplary Underlayment Assembly

In some aspects, a shock absorbing pad/underlayment assembly for use with the disclosed playing surface assemblies can comprise a composite nonwoven pad having a face surface and an opposed back surface. The nonwoven pad comprises a nonwoven blend of at least one reclaimed artificial turf material and a heat set binder material. The at least one reclaimed artificial turf material comprises at least one of face fibers, primary backing fibers, primary coating material, adhesive backing material, filler, infill, or any combination thereof. Depending on the component part(s) of synthetic turf reclaimed, it should be appreciated that reclaimed synthetic turf material can include any one or more of the materials described below as being used in the manufacture of conventional synthetic turf. An exemplary shock pad according to the present disclosure can be used as a separate underlayment or as an integral part of the playing surface assembly.

In certain aspects, the reclaimed artificial turf material can comprise a polyolefin, polyamide, polystyrene, polyurethane, polyester, polyvinyl chloride, polyacrylic, or any combination thereof. In certain aspects, the reclaimed artificial turf material comprises a polyolefin. In still further aspects, the polyolefin comprises a polyethylene, polypropylene, or a combination thereof. In still further aspects, the reclaimed artificial turf comprises a polyamide. In some aspects, the polyamide comprises nylon 6, nylon 6/6, nylon 1/6, nylon 12, nylon 6/12, or a combination thereof. In still further aspects, the reclaimed artificial turf comprises a polyester. In such aspects, the polyester comprises polyethylene terephthlate, polypropylene terephthalate, polybutylene terephthlate, or any combination thereof.

In an exemplary synthetic turf construction, the face fibers can make up from about 19 wt % to about 80 wt % of the overall synthetic turf, including exemplary values of about 20 wt %, about 30 wt %, about 40 wt %, about 50 wt %, about 60 wt %, and about 70 wt %. The primary backing material can make up from about 1 wt % to about 25 wt % of a synthetic turf, including exemplary values of about 5 wt %, about 10 wt %, about 15 wt %, and about 20 wt %. The adhesive backing material can make up from about 15 wt % to about 80 wt % of a synthetic turf, including exemplary values of about 20 wt %, about 30 wt %, about 40 wt %, about 50 wt %, about 60 wt %, and about 70 wt %.

The face fibers may include any material that is conventionally used in carpet manufacture, singly or in combination with other such materials. For example, the face fibers can be synthetic, such as, for example a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polybutylene terephthalate (PBT), polytrimethylene terephthalate (PTT), latex, styrene butadiene rubber, or any combination thereof. It is contemplated that the conventional nylon of the face fibers can be, for example and without limitation, nylon 6/6, nylon 6, nylon 10, nylon 10/10, nylon 10/11, nylon 11, and the like. Additionally, the face fibers can comprise natural fibers, such as cotton, wool, or jute. In exemplary aspects, the face fibers can comprise one or more biodegradable materials, including, for example and without limitation, polylactic acid (PLA).

In exemplary aspects, the face fibers may include from about 0 wt % to about 100 wt % polyethylene, from about 0 wt % to about 100 wt % polypropylene, and from about 0 wt % to about 100 wt % nylon. In some aspects, the face fibers include blends of polypropylene (PP) and polyethylene (PE) in any of the following ratios of PP:PE-5:95; 10:90; 50:50; 90:10; 95:5, or any ratio that is within these ranges of ratios. In some aspects, the face fibers include blends of PP and nylon in any of the following ratios of PP:nylon-5:95; 10:90; 50:50; 90:10; 95:5, or any ratio that is within these ranges of ratios. In some aspects, the face fibers include blends of PE and nylon in any of the following ratios of PE:nylon-5:95; 10:90; 50:50; 90:10; 95:5, or any ratio that is within these ranges of ratios. In some aspects, the face fibers include blends of PP, PE, and nylon in any of the following ratios of PP:PE:nylon-10:10:80; 10:80:10; 80:10:10; 33:33:33, or any ratio that is within these ranges of ratios.

The primary backing may include any material that is conventionally used in carpet manufacture, singly or in combination with other such materials. For example, the primary backing can be synthetic, such as, for example a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polytrimethylene terephthalate (PTT), polybutylene terephthlate (PBT), latex, styrene butadiene rubber, or any combination thereof. It is contemplated that the conventional nylon of the primary backing can be, for example and without limitation, nylon 6/6, nylon 6, nylon 10, nylon 10/10, nylon 10/11, nylon 11, and the like. Additionally, the primary backing can comprise natural fibers, such as cotton, wool, or jute. In exemplary aspects, the primary backing can comprise one or more biodegradable materials, including, for example and without limitation, polylactic acid (PLA).

In exemplary aspects, the primary backing may include from about 0 wt % to about 100 wt % polyester or from about 0 wt % to about 100 wt % polypropylene. Thus, in these aspects, it is contemplated that the primary backing may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of polyester. It is further contemplated that the primary backing may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of polypropylene. In some aspects, the primary backing includes blends of PP and polyester in any of the following ratios of PP:polyester-5:95; 10:90; 50:50; 90:10; 95:5, or any ratio that is within these ranges of ratios.

The adhesive backing can include polyurethane, latex, hot melt adhesive, and/or thermoplastics alone or in combination. Suitable hot melt adhesives include, but are not limited to, Reynolds 54-041, Reynolds 54-854, DHM 4124 (The Reynolds Company P.O. Greenville, S.C., DHM Adhesives, Inc. Calhoun, Ga.). Suitable thermoplastics include, but are not limited to polypropylene, polyethylene and polyester. The adhesive backing can also include a filler such as coal fly ash, calcium carbonate, iron oxide, or barium sulfate, or any other filler known in the art. The adhesive backing can include from about 0 wt % to about 100 wt % polyurethane, from about 0 wt % to about 100 wt % latex, from about 0 wt % to about 100 wt % hot melt adhesive, and/or from about 0 wt % to about 100 wt % thermoplastic. Thus, the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of polyurethane. It is further contemplated that the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % latex. It is further contemplated that the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % hot melt adhesive. It is still further contemplated that the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % thermoplastic polymer. The adhesive backing can include from about 0 wt % to about 80 wt % filler. Thus, the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, or at least 75 wt % filler. In some aspects, the adhesive backing includes polyurethane, latex, or thermoplastic and from about 20 wt % to about 80 wt % filler, or from about 40 wt % to about 60 wt % filler. In other aspects, the adhesive backing includes a blend of a hot melt component and from greater than 0 wt % to about 50 wt % filler, including for example, from about 1 wt % to about 25 wt % filler.

Synthetic turf may also include an infill material dispersed among the upstanding ribbons, which acts as a ballast and/or contributes to the physical properties of the turf, such as resiliency, that make the turf suitable for a particular use. Synthetic turf infill may be made of any material suitable for providing desired physical properties for the synthetic turf, but most often includes materials such as sand, gravel, cork, polymer beads, and rubbers, including but not limited to crumb rubber, ethylene propylene diene monomer (EPDM) rubber, and neoprene rubber. In still further aspects, the turf infill can also comprise at least one of silica sand, rubber crumb granules, organic component, ethylene propylene diene monomer (EPDM) rubber, thermoplastic elastomers, polyurethane or any combination thereof.

In certain aspects, the pad is further comprised of an artificial turf infill material embedded within the composite nonwoven pad. In such aspects, the disclosed pads can comprise reclaimed carpet materials that comprise an amount greater than 0 wt % of one or more of an artificial turf infill, a silica sand, a rubber granule, an organic component, ethylene propylene diene monomer (EPDM) rubber, thermoplastic elastomers, polyurethane, a dirt, natural soils, or a combination thereof. In yet other aspects, the reclaimed materials used in the disclosed pad comprise about 0.05 wt %, about 0.1 wt %, about 0.5 wt %, about 1 wt %, about 2 wt %, about 3 wt %, about 4 wt %, about 5 wt %, about 10 wt %, about 15 wt %, about 20 wt %, or about 30 wt % of one or more of an artificial turf infill, a silica sand, a rubber granule, an organic component, ethylene propylene diene monomer (EPDM) rubber, thermoplastic elastomers, polyurethane, a dirt, or a combination thereof.

In addition to fibrous reclaimed carpet material described above, it should be appreciated that reclaimed carpet material and reclaimed synthetic turf material can further comprise one or more impurities. For example, representative impurities that can be present include dirt, sand, oil, inorganic filler, and other conventionally known waste materials that can be present in reclaimed carpet or synthetic turf material.

In yet other aspects, the reclaimed artificial turf material used in the inventive pads can comprise a thermoset polymer, a thermoplastic polymer, or a combination thereof.

In certain aspects, the disclosed pad can comprise the at least one reclaimed artificial turf material in any desired amount. In some exemplary aspects, the at least one reclaimed artificial turf material can be present in the pad in an amount in the range of from greater than 0% to 100% by weight of the resulting pad, including exemplary amounts of about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, and about 95% by weight, as well as any amounts falling within ranges derived from these listed exemplary amounts. In still further aspects, the at least one reclaimed artificial turf material can be present in an amount within any range derived from the above values, including for example, an amount in the range of from greater than 0% by weight to 90% by weight, from 30% by weight to 70% by weight, or from 40% by weight to 60% by weight.

In yet other aspects, the pads disclosed herein can comprise at least one performance additive embedded within the nonwoven blend. The at least one performance additive used herein can comprise any known in the art recycled materials or virgin materials. In yet other aspects, the at least one performance additive can comprise a virgin polymer material, high denier fibers, low melt fibers, a resilient material, foam chips, rubber chips, cork, wood chops, silica sand, adhesive material, binder fibers, or any combinations thereof. It is understood that unless specifically identified, any of these materials can have a virgin or a recycled origin. It is further understood that any of the mentioned materials can undergo multiple recycling cycles prior to the use in the disclosed pads.

In still further aspects, the fibers present as the at least one performance additive can comprise a fiber having a denier from about 3 to 50, including exemplary values of about 5 denier per filament (DPF), about 8 denier per filament (DPF) about 10 denier per filament (DPF), about 12 denier per filament (DPF), about 15 denier per filament (DPF), about 20 denier per filament (DPF), about 25 denier per filament (DPF), about 30 denier per filament (DPF), about 35 denier per filament (DPF), about 40 denier per filament (DPF), and about 45 denier per filament (DPF). In yet other aspects, the high denier fiber comprises a fiber from about 50 denier per filament (DPF) to about 500 denier per filament (DPF), including exemplary values of about 100 denier per filament (DPF), about 150 denier per filament (DPF), about 200 denier per filament (DPF), about 250 denier per filament (DPF), about 300 denier per filament (DPF), about 350 denier per filament (DPF), about 400 denier per filament (DPF), and about 450 denier per filament (DPF). In yet other aspects, the fibers present in the disclosed pad can have a uniform denier value. In yet still other aspects, the fibers can have a large variety of denier values that falls within any of the above-mentioned values. In yet other aspects, the low melt fiber disclosed herein can have a denier from about 3 to 15 denier per filament (DPF). It is understood that as used herein, low melt fibers define fibers having a melting point between about 100° C. and about 180° C. In certain aspects, the melting point of the low melt fiber is about 110° C., about 120° C., about 130° C., about 140° C., about 150° C., about 160° C., or about 170° C.

In yet other aspects, the low melt material can also be present in the reclaimed carpet material. In some exemplary aspects, polypropylene, when present in the reclaimed carpet fibers, can be beneficially used as low-melt content for fusing surrounding higher melt fibers together.

In still other aspects, the low melt fibers used as the at least one performance additive can be obtained from one or more manufacturers, such as Wellman, Inc., Fiber Innovations, Inc., Huvis Corp., Tuntex Textile Co., Ltd., Stein, Inc., Reliance Industries, Ltd., and Teijin, Ltd.

In yet other aspects, the low melt fibers that are present as the at least one performance additive can comprise, for example and without limitation, a low-melt polyester, polypropylene, polyethylene, copolyester, copolymer nylons, engineered olefins, conjugate filament-linear low-density polyethylene, acrylics, low-melt nylon, and the like. As one having ordinary skill in the pertinent art will appreciate, the heating of a low-melt fiber in a disclosed pad can create globules of low-melt polymer at crossover points where the low-melt fibers intersect with higher-melt fibers.

In still further aspects, the at least one performance additive comprising the low-melt material can comprise glycol-modified polyethylene terephthalate (PETG). In yet other aspects, the at least one performance additive comprising the low-melt fiber can comprise an elastomeric low-melt fiber, including, for example and without limitation, ethylene vinyl acetate (EVA), thermoplastic elastomers (TPE), thermoplastic rubbers, thermoplastic olefins, and the like. As one having ordinary skill in the pertinent art will appreciate, the heating and re-curing of elastomeric low-melt fibers can create stretchable crossover points where the elastomeric low-melt fibers intersect with higher-melt fibers, thereby improving the load-bearing capabilities of the fiber pad.

In yet other aspects, the at least one performance additive comprising the low-melt fiber can comprise a bi-component fiber having a portion of high- or standard-melt material and a portion of low-melt polymer. In such aspects, the bi-component fiber configuration can be, for example and without limitation, islands-in-the-sea, side-by-side, core-sheath, and the like. As one having ordinary skill in the pertinent art will appreciate, bi-component fibers can maintain their original structural integrity while also allowing each fiber to glue itself to adjacent fibers. As one having ordinary skill in the pertinent art will further appreciate, the use of bi-component fibers increases the amount and strength of bonding between adjacent fibers due to the increased length of axial contact between the fibers. It is contemplated that any known materials having appropriate melt characteristics can be used to form the bi-component fibers.

In yet other aspects, the at least one performance additive comprising the low-melt material can comprise a low-melt powder, flake, or granule. It is contemplated that any of the above-referenced materials can be provided in a powder, flake, or granule form. In one aspect, scattering machines can be used to evenly disperse the low-melt powders, flakes, and granules throughout the pad. Manufacturers of these conventional scattering machines include TechnoPartner Samtronic, Technoboard, Caritec, and Schott Meissner.

In some aspects, the desired amount of the low-melt material can range from about 0% to about 80% of the total amount of material present within the disclosed pad, including exemplary values of about 5%, about 10%, about 20%, about 30%, about 40%, about 50%, about 60%, and about 70%. In yet other aspects, the low-melt material can be present in any amount between any foregoing values. For example, the low-melt material can be present from about 5% to about 60% of the total amount of material in the pad, or from about 10% to about 40% of the total amount of material in disclosed pad. It is contemplated that the at least one low-melt material can have any denier that is appropriate for a particular application, including any denier ranging from about 1 to about 1,500 denier per filament. For example, the at least one low-melt material can have any denier ranging from about 1 to about 1,500 denier per filament, including exemplary values of about 5 denier per filament, about 10 denier per filament, about 20 denier per filament, about 50 denier per filament, about 100 denier per filament, about 200 denier per filament, about 300 denier per filament, about 400 denier per filament, about 500 denier per filament, about 600 denier per filament, about 700 denier per filament, about 800 denier per filament, about 900 denier per filament, about 1,000 denier per filament, about 1,100 denier per filament, about 1,200 denier per filament, about 1,300 denier per filament, and about 1,400 denier per filament.

In yet other aspects, the at least one performance additive can comprise a resilient material. In certain aspects, the resilient material comprise one or more of ethylene-propylene-diene monomer rubber (EPDM), ethylene-propylene monomer rubber (EPM), acrylonitrile-butadiene (NBR), styrene-butadiene (SBR), carboxylated NBR, carboxylated SBR, styrene block copolymer, thermoplastic elastomer, flexible very low density polyethylene resins, or a combination thereof.

In still further aspects, the heat set binder present in the disclosed pad comprises a low-melt fiber. In yet other aspects, the heat set binder is a low-melt binder. In still further aspects, the low-melt fiber present as the heat set binder can be any low-melt fiber disclosed above. In still further aspects, the heat set binder can comprise any of the low-melt fibers disclosed above. In yet other aspects, the heat set binder can comprise a low-melt powder. In still further aspects, heat set binder can comprise a bi-component low melt binder.

In still further aspects, the nonwoven blend further comprises at least one reclaimed carpet material. As disclosed herein, the reclaimed carpet material can comprise a post-consumer carpet material, a post-industrial carpet material, or a combination thereof. It is understood that the at least one reclaimed carpet material present in the disclosed pad can comprise any material that is conventionally used in a carpet manufacture. For example, the at least one reclaimed carpet material can be synthetic, such as, for example a material comprising one or more of a conventional nylon, polyester, polypropylene (PP), polyethylene (PE), polyurethane (PU), polyvinyl chloride (PVC), polyethylene terephthalate (PET), polytrimethylene terephthalate (PTT), latex, polyacrylic, styrene butadiene rubber, or any combination thereof. It is contemplated that the conventional nylon of the reclaimed carpet material can be, for example and without limitation, nylon 6/6, nylon 6, nylon 10, nylon 10/10, nylon 10/11, nylon 11, and the like. Additionally, the reclaimed carpet material can comprise natural fibers, such as cotton, wool, or jute. In exemplary aspects, the reclaimed carpet material can comprise one or more biodegradable materials, including, for example and without limitation, polylactic acid (PLA). According to aspects of the invention, a reclaimed carpet material comprising synthetic and/or natural materials described above can optionally be present as a reclaimed carpet fiber. Any one or more of the above disclosed materials can be obtained from various component parts of the prior manufactured carpet product, for example and without limitation, a reclaimed carpet material can be obtained from a face layer, an adhesive layer, a backing layer, a secondary backing layer, an underlayment, a cushioning material, a reinforcing layer, or a scrim, or any combination thereof.

Additionally, the reclaimed carpet material can also comprise fillers. The fillers can be any suitable filler, including, for example, aluminum oxide trihydrate (alumina), calcium carbonate, barium sulfate or mixtures thereof. The fillers can be virgin filler, waste material, or even reclaimed fillers. Examples of recycled fillers include coal fly ash and calcium carbonate. In the aspects wherein the reclaimed carpet material comprises an artificial turf, the reclaimed material can also comprise an amount of infill materials commonly used in the turf. In such exemplary aspects, the reclaimed material can comprise an amount of silica sand, rubber granules, organic components, dirt, any combination thereof, and the like.

The reclaimed carpet material can be obtained from a variety of sources. In one example, the reclaimed carpet material can be obtained from a collection site. Approximately 50 collection sites are positioned throughout the United States. These collection sites take in a post-consumer carpet which is then shipped to a facility for sorting according to a fiber type. Once sorted, a baled material of primarily the same or similar fiber type is then shipped to a secondary location where various techniques are employed for reducing the large pieces of carpet to small chunks or shredded fiber and to provide an amalgamated mixture. The amalgamated mixture will typically contain face fibers, a primary backing, a secondary backing, a carpet binder and, in some cases, an attached cushion. After this stage, the product can be used with or without further refinement or processing to remove additional contaminates. In some aspects, the reclaimed carpet material can be obtained directly from the site, bypassing a collection site.

For use in connection with various aspects of the present invention and, dependent on the end use and desired cost of the product, reclaimed carpet material can comprise a relatively coarse blend of ground or shredded post-consumer carpet (PCC) or a more refined less coarse material containing primarily opened carpet face fibers. According to some aspects, the reclaimed carpet material can, for example, comprise relatively coarse slit tape fibers derived from reclaimed primary and secondary backing materials. The coarse material is able to provide a low-cost structural material that can serve as reinforcement for the pad products described herein. In some aspects, additional processing steps can be desirable. For example, the post-consumer carpet material can be further chopped or sheared into any desired size, including for example, fiber or tape yarn lengths in the range of from about 1/64 inch to about 3 inches.

According to certain aspects, the fibrous material present within the reclaimed carpet material exhibits a substantially uniform size, including substantially uniform liner density measured in denier units and substantially uniform fiber lengths. However, in alternative aspects, fibers present within the reclaimed carpet material can have non-uniform linear densities and non-uniform fiber lengths. According to these aspects, a population of reclaimed carpet fibers having non-uniform linear fiber densities can, for example, have individual linear fiber densities in the range of from about 1 to about 1,500 denier per filament (DPF), including exemplary values of about 1 to about 1,500 denier per filament, including exemplary values of about 5 denier per filament, about 10 denier per filament, about 20 denier per filament, about 50 denier per filament, about 100 denier per filament, about 200 denier per filament, about 300 denier per filament, about 400 denier per filament, about 500 denier per filament, about 600 denier per filament, about 700 denier per filament, about 800 denier per filament, about 900 denier per filament, about 1,000 denier per filament, about 1,100 denier per filament, about 1,200 denier per filament, about 1,300 denier per filament, and about 1,400 denier per filament. Still further, a population of reclaimed carpet fibers having non-uniform linear density can collectively provide an average linear fiber density that is, for example, greater than 1 DPF, greater than 10 DPF, greater than 50 DPF, greater than 100 DPF, greater than 500 DPF, greater than 1,000 DPF, or even greater than 1,500 DPF.

In addition to fibrous reclaimed carpet material described above, it should be appreciated that reclaimed carpet material can further comprise one or more impurities. For example, representative impurities that can be present in reclaimed carpet material, and thus, present in the pads described herein include dirt, sand, oil, inorganic filler, and other conventionally known waste materials that can be present in reclaimed carpet material.

In yet other aspects, the reclaimed carpet material used in the inventive pads can comprise a thermoset polymer, a thermoplastic polymer, or a combination thereof.

In still further aspects, the reclaimed carpet material comprises a polyolefin, polyamide, polystyrene, polyurethane, polyester, polyacrylic, polyvinyl chloride, or any combination thereof. In yet other aspects, the polyolefin present in any part of the reclaimed carpet material comprises any of the mentioned above polyolefins. In certain aspects, the polyolefin comprises a polyethylene, polypropylene, or a combination thereof. It is understood that the polyamide present in any part of the reclaimed carpet material comprises any of the mentioned above polyamides. In certain aspects, the polyamide comprises nylon 6, nylon 6/6, nylon 1/6, nylon 12, nylon 6/12, or a combination thereof. In still further aspects, it is understood that the polyester present in any part of the reclaimed carpet material comprises any of the mentioned above polyesters. In some exemplary aspects, the polyester comprises polyethylene terephthalate, polypropylene terephthalate, polybutylene terephthlate, or any combination thereof. In yet further aspects, the reclaimed carpet material can comprise crosslinked styrene-butadiene copolymer, a crosslinked ethylene vinyl acetate copolymer, or a combination thereof. It is understood that the disclosed pad can use one or more materials originated from the reclaimed carpet materials. It is further understood that the materials originated from the reclaimed carpet material do not have to be chemically similar to be used in the inventive pad.

In certain aspects, the disclosed pad can comprise the reclaimed carpet material in any amount. In some exemplary aspects, the reclaimed carpet material can be present in the pad in an amount in the range of from greater than 0% to 100% by weight of the resulting pad, including exemplary amounts of about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, and about 95% by weight, as well as any amounts falling within ranges derived from these listed exemplary amounts. In still further aspects, the reclaimed carpet material can be present in an amount within any range derived from the above values, including for example, an amount in the range of from greater than 0% by weight to 90% by weight, from 30% by weight to 70% by weight, or from 40% by weight to 60% by weight.

In yet other aspects, the shock pad disclosed herein can further comprise a reinforcing scrim adhered to one of the face surface or back surface. In some aspects, the scrim comprises a non-woven fiberglass, a wet-laid fiberglass, a non-woven thermoplastic fabric, a woven thermoplastic fiber, or a combination thereof. In certain aspects, the reinforcing scrim is permeable on the top. In still further aspects, the reinforcing scrim is permeable at the bottom. In still further aspects, the reinforcing scrim is impermeable at the bottom. In yet other aspects, the reinforcing scrim is permeable on the top and permeable on the bottom. In still further aspects, the reinforcing scrim is permeable on the top and impermeable at the bottom. In the aspects where the reinforcing scrim is impermeable at the bottom the disclosed pad can enhance drainage in a lateral direction. In still further aspects, a polyethylene extruded sheet can be applied to the bottom of the pad to seal the pad. In yet other aspects, any other film or an impermeable spray-coat can be applied to the bottom of the pad. It should be understood that any of the aforementioned means for sealing the bottom of the pad can also provide a separation layer that enhances lateral drainage of the pad as described in more detail below. In certain aspects, the scrim can behave as a visual enhancement. In yet other aspects, the scrim can help to ensure pad's impermeability. In certain aspects, the heat and pressure applied to the pad seals the pad construction. In yet other aspects, the polyethylene film applied to the bottom of the pad can form an impermeable feature that can, for example, be suitable for use as a geotextile membrane.

In still further aspects, the shock pad further comprises a polymer film adhered to the back surface of the nonwoven pad. In yet other aspects, the polymer film comprises a thermoplastic material. In yet other aspects, the polymer film is a thermoplastic film. In other aspects, the polymer film comprises polymers and copolymers of polyethylene, polypropylene, polyurethane, polyester, polyvinylchloride, nylon and polyethylene vinyl acetate. In yet other aspects, the polymer film comprises polyethylene, polypropylene, polyurethane, polyester, polyvinyl butyral, or polyvinylchloride, or a combination thereof. In a yet further aspect, the polymer film is polyethylene. In yet further aspects, the polymer film is a combination of polyethylene and polyester.

In some aspects, the polymer film disclosed herein is a fluid barrier. In yet other aspects, the polymer film is fluid impermeable. In still further aspects, the polymer film is substantially impermeable. In yet other aspects, the polymer film is semipermeable material. In certain aspect, the polymer film is impermeable or substantially impermeable to gases and/or fluids. In one aspect, the polymer film is impermeable (or substantially impermeable) to aqueous fluids. In another aspect, the polymer film is impermeable (or substantially impermeable) to non-aqueous fluids. In further exemplary aspects, the polymer film is impermeable (or substantially impermeable) to water, human or pet bodily fluids, food fluids, food processing fluids, rain, or snow. In yet other aspects, the polymer film is a moisture barrier film. In some aspects, the moisture barrier film is adhered to the back surface of the nonwoven pad.

In certain aspects, the polymer film disclosed herein is an extruded film. In yet other aspects, the polymer film disclosed herein is a blown film. In a yet further aspect, the polymer film is a cast film. In a still further aspect, the polymer film is an engineered film. The term "engineered film" as used herein refers to a polymer film comprising same or different polymers and copolymers, wherein the film is formed by various techniques to ensure desirable properties. In some aspects, the engineered film is a reinforced film. In some aspects, and without limitation, the engineered reinforced film can comprise a plurality of layers of the same or different polymer or copolymer. In other aspects, the engineered film can comprise layers of polyethylene film sandwiched with a layer of polyester. In yet further aspects, the engineered film can comprise layers of polyethylene and polypropylene, or layers of polyethylene and chemically resistant ethylene vinyl alcohol (EVOH) copolymer. In certain aspects, the engineered film used in the current disclosure can be purchased from Raven Industries, P&O Packaging, Mid-South Extrusion, or Direct Packaging.

As disclosed herein, in some aspects, the polymer film can have a thickness of less than about 6 mils. In other aspects, the polymer film can have a thickness of exemplary values of about 5.5 mils, about 5 mils, about 4.5 mils, about 4 mils, about 3.5 mils, about 3 mils, about 2.5 mils, about 2 mils, about 1.5 mils, about 1 mil, and about 0.5 mils. In other aspects, the polymer film can have a thickness in any range derived from any two of the above stated values. For example, and without limitation the polymer film can have thickness from about 1 mil to about 5.5 mils, or from about 2 mils to about 4 mils, or from about 1 mil to about 3.5 mils.

In some other aspect, the polymer film can have a thickness of greater than about 10 mils. In other aspects, the polymer film can have a thickness of exemplary values of about 10 mils, about 15 mils, about 20 mils, about 25 mils, about 30 mils, about 35 mils, about 40 mils, about 45 mils, about 50 mils, about 55 mil, about 60 mils, about 65 mils, about 70 mils, about 75 mils, about 80 mils, about 85 mils, about 90 mils, and about 100 mils. In other aspects, the polymer film can have a thickness in any range derived from any two of the above stated values. For example, and without limitation the polymer film can have thickness from about 10 mils to about 40 mils, or from about 30 mils to about 50 mils, or from about 30 mil to about 80 mils.

In some aspects, the polymer film used herein is continuous. In other aspects, the polymer film is substantially free of perforations or pinholes. In yet other aspects, the polymer film is continuous and substantially free of perforations.

In still further aspects, the composite nonwoven pad can have a thickness extending between the face surface and the opposed back surface in the range of from about 0.10 inches to about 7 inches, including exemplary values of about 0.5 inch, about 1 inch, about 2 inch, about 3 inch, about 4 inch, about 5 inch, and about 6 inch. In yet other aspects, the thickness can be in the range between any foregoing values. For example, the thickness pad can be from about 0.15 inches to about 2 inches, from about 0.20 inches to about 1 inch, or from about 0.5 inch to about 5 inch.

In other aspects, the pad can have any width. In certain aspects, the width is in the range of from about 5 inch to about 250 inch, including exemplary values of about 10 inch, about 20 inch, about 30 inch, about 40 inch, about 50 inch, about 60 inch, about 70 inch, about 80 inch, about 90 inch, about 100 inch, about 110 inch, about 120 inch, about 130 inch, about 140 inch, about 150 inch, about 160 inch, about 170 inch, about 180 inch, about 190 inch, about 200 inch, about 210 inch, about 220 inch, about 230 inch, and about 240 inch. In yet other aspects, the width can be in the range between any foregoing values. For example, the width can be from about 5 inch to about 150 inch, about 20 inches to about 200 inches, or from about 50 inch to about 100 inch.

In yet further aspects, the shock absorbing pads described herein can have any desired density. In some exemplary aspects, the pad can have any desired density in the range of from about 0.5 to about 30 lbs/ft$^3$, including exemplary values of about 1 lbs/ft$^3$, about 2 lbs/ft$^3$, about 3 lbs/ft$^3$, about 4 lbs/ft$^3$, about 5 lbs/ft$^3$, about 6 lbs/ft$^3$, about 7 lbs/ft$^3$, about 8 lbs/ft$^3$, about 9 lbs/ft$^3$, about 10 lbs/ft$^3$, about 11 lbs/ft$^3$, about 12 lbs/ft$^3$, about 13 lbs/ft$^3$, about 14 lbs/ft$^3$, about 15 lbs/ft$^3$, about 16 lbs/ft$^3$, about 17 lbs/ft$^3$, about 18 lbs/ft$^3$, about 19 lbs/ft$^3$, about 20 lbs/ft$^3$, about 21 lbs/ft$^3$, about 22 lbs/ft$^3$, about 23 lbs/ft$^3$, about 24 lbs/ft$^3$, about 25 lbs/ft$^3$, about 26 lbs/ft$^3$, about 27 lbs/ft$^3$, about 28 lbs/ft$^3$, and about 29 lbs/ft$^3$. In yet other aspects, the pad can have a density value between any two foregoing values. For example, the pad can have a density value in the range from about 2 lbs/ft$^3$ to about 30 lbs/ft$^3$, or from 10 lbs/ft$^3$ to about 20 lbs/ft$^3$.

In yet other aspects, the pad disclosed herein can have regions or portions of varying densities. For example, the pad can comprise a first portion having a first density and a second portion having a second density different from the first density. In some aspects, the first portion of the pad is adjacent to the face surface. In other aspects, the second portion of the pad is adjacent to the opposed back surface. In certain aspects, the first density is larger than the second density. In still other aspects, the first density is lower than the second density. In certain aspects, the varying densities of the pad can be obtained by any known in the art methods. In yet some aspects, varying density can be achieved by applying needling methods.

In still further aspects, optionally and without limitations, the pad can comprise any desired amount of spray-on binder liquids, including, for example and without limitation, acrylics, water-dispersed thermoplastics, cross-linked thermosets, polyurethanes, polymerizable compounds, and the like. As one having ordinary skill in the pertinent art will appreciate, upon exposure to elevated temperatures, these binders can cross-link, polymerize, and drive off water or solvents. As one having ordinary skill in the pertinent art will further appreciate, after exposure of the binders to elevated temperatures, residual portions of the binders can bond adjacent fibers together to improve the dimensional stability of the pad. It is contemplated that these binders can be applied to the pad using any spray-on techniques as are conventionally used in the pertinent art.

In still further aspects, a turf system that incorporates inventive pads as described herein can exhibit Gmax values of less than about 200 g's as measured according to ASTM F-355. This ASTM standard test consists of a guide tube of about 2.5 feet tall, and a 20-pound cylindrical weight that falls through the tube. An accelerometer mounted on the weight measures how rapidly the missile decelerates or stops. The flat-faced "missile" is connected to a velocity measuring device that records the velocity as the missile hits the surface and the G-forces that are experienced during decelerations. In still further aspects, when the shock pad is present as a component in an artificial turf system or a playing surface system, the system can exhibit a Gmax value less than about 165 g's as measured according to ASTM F-355. In yet other aspects, when the shock pad is present as a component in an artificial turf system or a playing surface system, the system can exhibit Gmax values less than about 195 g's, less than about 190 g's, less than about 185 g's, less than about 180 g's, less than about 175 g's, less than about 170 g's, less than about 165 g's, less than about 160 g's, less than about 155 g's, less than about 150 g's or less than about 145 g's. Such systems can comprise the inventive pads, turf or reinforcement elements, and optionally, infill material.

In still further aspects, a system that incorporates exemplary pads can exhibit Gmax value of less than 165 g's as measured according to Synthetic Turf Council Guidelines (STC), including exemplary values of less than about 160 g's, less than about 155 g's, less than about 150 g's and less than about 145 g's.

In still further aspects, a system incorporating pads described herein can exhibit the Head Injury Criterion (HIC) test values of equal to or less than about 1,000, less than about 900, less than about 800, less than about 700, or less than about 600. As one of ordinary skill in the art would readily appreciate, the "Head Injury Criterion" Test, or HIC Test, is the internationally recognized measure for the likelihood of head injury.

As cited in Ratte, D. J. ((1990) "Development of Human Factors Criteria For Playground Equipment Safety." Silver Spring, Md.: COMSIS Corporation), the Head Injury Criteria (HIC) is an alternate interpretation of the 1970 Wayne State Tolerance Curve (WSTC) (King and Ball, 1989). As Ratter states, the portion of the impact pulse covered by the HIC was intended to taking into account the rate of load application, which is thought to be critical in determining soft tissue injury (Committee on Trauma Research, 1985; Goldsmith and Ommaya, 1984.) Per Ratte, an HIC value of 1,000 is taken as the concussion tolerance threshold and is currently used by the US Department of Transportation as the standard for evaluating head injury and testing safety systems (e.g. restraint systems) in the context of vehicular collisions.

In certain aspects, the HIC impact test uses a Triax 2010 device that allows measuring the force of a human head when it strikes a playing surface. By following the protocol established by the American Standard for Testing Materials for the F355-16 E-Missile the probability and severity of a head injury can be determined. The HIC Impact Test drops a 9.9 lb. hemisphere projectile (curved like a human head) from increasing heights and measures the impact. It is understood that the higher Critical Fall Height, the safer the surface. The disclosed pad when present as a component in an artificial turf or playing surface system, results in a system that can produce a minimum Critical Fall Height of about 1.3 m to about 1.7 m. In some exemplary aspects, Rugby Federation Standard (International Rugby Board (IRB) standard) requires the turf/playing surface to meet the standard of 1,000 HIC from 1.3 m.

In yet other aspects, the HIC impact can be measured according to European Standard DIN EN1177 at 23° C. or 40° C. to show the HIC equal to or less than 1,000 at fall height of about 1.0 m to about 1.3 m. In still further aspects, a turf or playing surface system that incorporates inventive pads as described herein can exhibit the Head Injury Criterion (HIC) test values measured according to European Standard DIN EN1177 at 23° C. or 40° C. to show the HIC less than about 900, less than about 800, less than about 700, or less than about 600.

In a further aspect, the shock absorbing pads of the instant disclosure exhibit excellent compression set values. Products with high compression set will generally leave noticeable, long-term indentations. In particular aspects of the present invention, the compression set of the pads described herein can be from about 1 to about 40%, where the % refers to the % recovery of the pad. The compression is measured according to ASTM D3676 and ASTM D3574 standards. The methods require stacking a number of 2"×2" specimens to obtain about 1 inch of thickness, this thickness is recorded as an initial thickness $T_1$. The sample, then, is pressured and compressed to 50% of its original thickness. The compressed specimen is placed into the air circulating oven at 158° F. (+/−2° F.) for 22 hours (+/−0.5 hour). After the samples are removed from the air circulating oven, the sample are given to recover at 73° F. (+1-4° F.) and 50% (+/−5%) relative humidity atmosphere from either 30 min (ASTM D3574) or 4-5 hours (ASTM D3676). The thickness $T_2$ has been measured by end of the recovering step and compression set as a % of thickness loss was calculated according to $$Cs=T_1-T_2.$$

Still further, the compression set of the pads is from about 1, 2, 3, 4, 5, 6, 7, 8, 9, 10, 11, 12, 13, 14, 15, 16, 17, 18, 19, 20, 21, 22, 23, 24, 25, 26, 26, 28, 29, or 30%, where compression set is measured in accordance with the parameters herein, and where any value can form an upper or a lower endpoint as appropriate.

In still further aspects, the shock absorbing pads of the instant disclosure exhibit excellent compression resistance values. The compression resistance is measured according to ASTM D3676 standard. This method evaluates the load required to compress sample to some predetermined amount of its original thickness. It is used as an indicator of how well a shock absorbing pad resists "bottoming out" under a given load. Typical compression resistance is measured at 25% and 65% of compression. In these aspects, the compression resistance for 25% and 65% corresponded to a load of 5.37 lb and 149.27 lb respectively. In this test method 2"×2" specimens are stacked to obtain about 1 inch of thickness, conditioned to equilibrium at 50% (+1-5%) relative humidity and at 73° F. (+/−4° F.), and then compressed to 25% or 65% with a press. The compression resistance is measured according to:

$C_r = A$ (force in pounds, lbs)/$B$ (area, in square inches).

The max compression recovery can be from about 1 to about 30%, including exemplary values of about 2, 3, 4, 5, 6, 7, 8, 9, 10, 11, 12, 13, 14, 15, 16, 17, 18, 19, 20, 21, 22, 23, 24, 25, 26, 26, 28, and 29. In yet other aspects, the compression recovery can be from about 1 to about 95% after 48 hours, including exemplary aspects of about 2, 3, 4, 5, 6, 7, 8, 9, 10, 11, 12, 13, 14, 15, 16, 17, 18, 19, 20, 21, 22, 23, 24, 25, 26, 26, 28, 29, 30, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 833, 84, 85, 86, 87, 88, 89, 90, 91, 92, 93, and about 94% as measured according to ISO 3416-1986 standard.

In yet other aspects, the friction of the pad can be measured on both sides as measured according to the ASTM C1028 standard or according to the ASTM D1894. The ASTM C1028 is used to measure the static coefficient of friction for flooring surfaces such as carpet, ceramic tile, laminate, and wood under both wet and dry conditions while utilizing Neolite Heel Assemblies. The test can be used in the laboratory or on the field. The static coefficient of friction is measured as the ratio of the horizontal component to force applied to a body to overcome the friction or resistance to slipping to the vertical component of the weight of the object or force applied to it.

In still further aspects, the shock pad disclosed herein can exhibit beneficial drainage characteristics. This drainage can be in a vertical direction, a lateral or horizontal direction, or a combination of both. In some aspects, either the face or back surface can be profiled to provide pathways for drainage. For example, the nonwoven pad can be configured such that it defines a plurality of channels extending from the face surface to the opposed back surface 118 (FIG. 26). In certain aspects, each channel of the plurality of channels has a first outer periphery on the face surface and a second outer periphery on the opposite back surface. In other aspects, the first and second outer peripheries define a diameter of the channel. In still further aspects, the each channel of the plurality of channels is spaced apart along the length and/or width of the nonwoven pad. It is understood that the each channel of the plurality of channels is in a fluid communication with the face and the opposite back surfaces of the pad providing a path for vertical drainage. In still further aspects, the nonwoven construction can also provide permeability to the pad.

In yet other aspects, a plurality of channels can be configured in either the face or back surface extending laterally along a surface to provide enhanced lateral or horizontal drainage. Still further, a separation layer can be present as noted above. This too can enhance lateral drainage toward the edges of the shock pad rather than draining through the pad from one face to another. The horizontal drainage can be used to define a hydraulic transmissivity of the disclosed pads.

In certain aspects, the plurality of channels can be circular in cross-section, or can have any of various other cross-sectional shapes, including but is not limited to elliptical shape, oval shape, polygonal shape, star like shape, and like. In certain aspects, each of the plurality of channels can have a diameter from about 1 mm to about 15 mm, including exemplary values of about 2 mm, about 3 mm, about 4 mm, about 5 mm, about 6 mm, about 7 mm, about 8 mm, about 9 mm, about 10 mm, about 11 mm, about 12 mm, about 13 mm, and about 14 mm. It is further understood that each of the plurality of the channels can have any diameter between any foregoing values.

Yet in other aspects, the plurality of channels present in the shock absorbing pad have a percent open area from about 1% to about 10% based on 1 m2 of the pad, including exemplary values of about 2%, about 3%, about 4%, about 5%, about 6%, about 7%, about 8%, and about 9% based on 1 m2 of the pad.

In certain aspects, the disclosed pad can provide a free flowing vertical drainage system. The drainage can be measured according to ASTM D3385 standard. In some aspects, the vertical drainage can accommodate up from about 10 in/h to about 7,000 in/h of fluid flow, including exemplary values of about 50 in/h, about 100 in/h, about 500 in/h, about 1,000 in/h, about 2,000 in/h, about 3,000 in/h, about 4,000 in/h, about 5,000 in/h, and about 6,000 in/h. In yet other aspects, the vertical drainage can accommodate any water flow between the two foregoing values. The vertical drainage can be used to define the permeability of the disclosed pads.

In still further aspects, the second outer periphery of the plurality of channels on the opposed back surface opens to the polymer film attached to the back surface of the nonwoven pad. In such aspects, polymer film provides a plane for a lateral drainage of the fluid conveyed by the plurality of channels. In yet other aspects, the disclosed pad comprising a polymer film can provide a free flowing lateral drainage system. In some aspects, the lateral drainage can accommodate up from about 5 in/h to about 5,000 in/h of fluid flow, including exemplary values of about 10 in/h, about 20 in/h, about 50 in/h, about 100 in/h, about 500 in/h, about 1,000 in/h, about 2,000 in/h, about 3,000 in/h, and about 4,000 in/h. In yet other aspects, the lateral drainage can accommodate any water flow between the two foregoing values.

In yet further aspects, disclosed herein is a composite nonwoven pad further comprising opposing first and second side edges, and wherein the plurality of side edges define an edge locking structure. The disclosed pads can be installed to provide a plurality of adjacent shock absorbing pads in any selected orientation. Each of the plurality of adjacent shock absorbing pads comprises the composite nonwoven pad comprising a plurality of side edges extending between the opposed top and bottom surfaces, wherein the plurality of side edges define an edge locking structure. It is understood that the interlocking structures can be any structures known in the art and defined herein. In certain aspects, the opposing first and second side edges can comprise optional tongue/grove features.

In still further aspects, the composite nonwoven pad can be provided in any form known in the art. In some aspects, the composite nonwoven pad has a continuous length and is rolled into a roll. In such aspects, the roll is unrolled on installation site. In other aspects, the composite nonwoven pad can be provided in a slab form. In such aspects, the pad form a plurality of adjacent shock pads present in interlocking installation. In still further aspects, the face and opposed back surface of the composite nonwoven pad disclosed herein is substantially horizontal.

It is understood that in some aspects, the pad disclosed herein can be used as an underlayment for an indoor artificial turf or an indoor playing surface assembly. In still further aspects, the pad disclosed herein can be used as an underlayment for an indoor artificial turf, an outdoor artificial turf, an indoor playing surface assembly, an outdoor playing surface assembly, or a combination thereof. For example, it is contemplated that portions of the overall system can be indoors, while other portions of the system are outdoors. In yet other aspects, the pad disclosed herein can be useful in construction of, for example and without limitation, a soccer, baseball, hockey, lacrosse, gym floor, football, or a rugby field. It is understood that the pads disclosed herein are recyclable to produce third, or fourth generation products. In fact, it is further understood that the pad disclosed herein can undergo multiple recycle cycles. As one of ordinary skill in the art would readily appreciate such versatility of the disclosed pads make these pads very attractive for use in the industry due to their cradle-to-cradle (C2C) design.

Methods of Making the Disclosed Underlayment Assemblies

The present disclosure further provides a method of making a shock absorbing pads using reclaimed artificial turf materials and reclaimed carpet materials. This method provides alternative avenues for disposing of reclaimed artificial turf and reclaimed carpet materials in a manner that significantly reduces or can even eliminate the need to send the material to landfill sites.

The method described herein can be used to recycle and reuse any reclaimed artificial turf and reclaimed carpet materials described above, or other synthetic surfaces having chemical make-up similar to carpets or synthetic turfs.

By recycling and incorporating reclaimed artificial turf materials and reclaimed carpet materials into shock absorbing pads, several advantages can be realized. For example, second generation products, such as shock absorbing pads described herein, incorporating the reclaimed material have less of an environmental footprint relative to traditional materials, comprising only virgin materials. In further aspects, the use of reclaimed turf and carpet materials reduces the amount of traditional, often environmentally harmful materials that previously were sent to landfill, while still providing the same or similar level of product performance. Still further, substitution of virgin material with reclaimed turf and carpet materials can reduce the manufacturing costs associated with producing various first generation products.

In certain aspects, disclosed herein is a method of a pad comprising: a) forming a composite blend of at least one reclaimed artificial turf material and a binder material wherein the at least one reclaimed artificial turf material comprises face fibers, primary backing fibers, adhesive backing, or any combination thereof; b) forming the composite blend into a composite web; and c) treating the composite web to set the binder material under conditions effective to provide a composite nonwoven pad. In still further aspects, the step of treating comprises heat treating, pressurizing, calendaring, or a combination thereof.

As disclosed in details above, the at least one reclaimed artificial turf material can comprise any artificial turf materials known in the art. It is understood that the at least one reclaimed artificial turf material can comprise a post-consumer, a post-industrial material or a combination thereof. Likewise, the at least one reclaimed artificial turf material can be obtained from a variety of sources. In one example, the at least one reclaimed artificial turf material can be obtained from a collection site. The collection sites take in a post-consumer carpet/turf, which is then shipped to a facility for sorting by fiber type. Once sorted, baled material of the same fiber type is then shipped to a secondary location where various techniques are employed for reducing the large pieces or fragments of turf to small chunks or shredded fiber to provide an amalgamated mixture. In yet other aspects, the baled reduction of large pieces or fragments of turf to small chunks or shredded fiber to provide an amalgamated mixture can be done at the same collection facilities. It is understood that the steps describes herein can be done at the same or a different location. After this stage, the product can be used with or without further refinement or processing to remove additional contaminates. Alternatively, the reclaimed turf material can be obtained directly from the point of installation as described below. The reclaimed turf material can be also obtained directly from field sites upon turf filed replacement.

In some aspects, the process of reclaiming the artificial turf material can begin at the point of installation or the point of manufacturing if the reclaimed turf material is of a post-industrial origin. In some exemplary aspects, the process of reclamation begins at the point of installation. In such aspects, prior to step a) the at least one reclaimed artificial turf material is collected from an installation point. For a typical sports field, the synthetic turf is commonly installed by unrolling a roll of synthetic turf, such as, for example, a 15 foot wide by 150 foot long roll of turf. A field typically requires multiple rolls, which are laid out on the field side by side and seamed (glued or welded) together to form the field. Once seamed together, infill is then installed. The infill may be one or more of sand, rubber, and/or any other suitable material as previously described above. When a synthetic turf is removed from a point of installation, typically at least a portion of the infill is separated from the turf. The infill can be removed prior to the removal of the turf, at the same time, or even after the turf has been removed. For example, a machine may collect the infill and place it into a container or onto the field. The turf and infill can be removed at the same time by a machine or by hand.

In certain aspects, there is no need to shred the face fibers from the primary backing material after removal of the infill material. It is understood that by eliminating the step of shredding, the process becomes more efficient and economically valuable. In some exemplary aspects, however, after removal of the infill material, the face fibers of the synthetic turf material can optionally be sheared from the primary backing material. As described above, the sheared face fibers will typically comprise polyethylene, polypropylene, nylon, or other materials singly or in combination. In these exemplary aspects, the remaining carcass material, comprised primarily of primary backing, precoat, filler, secondary backing, and residual face fibers can also be collected and shipped for subsequent recycling processes.

In certain aspects, still prior to the step a), the reclaimed carpet material is size reduced. In some aspects, whether the entire turf (including face fibers and backing materials) is removed intact or the face fibers are, optionally, first sheared from the carcass, the recovered turf can optionally be downsized from the initial roll size into smaller sections (e.g., 1 by 1 foot, or 4 ft rolls, or 7.5 ft rolls for ease and efficiency of shipping) that can be accepted by the next processing step in the reclamation process. The downsizing may be accomplished by hand or machine. The machine may be large or small and may, for example, use rotary blades or knifes or any of a variety of different methods known in the art.

Optionally, fines can be removed from the recovered turf using conventional cleaning equipment. The cleaning equipment can comprise, for example and without limitation, step cleaners, willows, cyclone separators, vertical vibrating chutes, horizontal vibratory screeners, multi-aspirators, rotary sifters, condensers and other methods of cleaning. In use, the cleaning equipment uses airflow to pass fibers across one or more screens. The holes in the screens are too small for the fiber to pass through, but large enough for fines and other contamination to pass through when vacuum is applied. Manufacturers of exemplary cleaning equipment include Dell Orco & Villani Srl, Vecoplan, Wilson Knowles and Sons Ltd, Southern Mechatronics, Signal Machine Company Inc, Kice Industries Inc, Sterling Systems Inc, Pallmann GmbH, OMMI SpA, Pierret Industries Sprl, eFactor 3 LLC, Tria S.p.A, WEIMA America Inc, SSI Shredding Systems Inc, Erko-Trutzschler GmbH, and LaRoche S A, among others.

It is further understood that in the aspects described herein the at least one reclaimed artificial turf material can comprise face fibers, primary backing, and adhesive backing. It is further understood that in some aspects, the formed composite blend can also comprise an artificial turf infill material. As described in detail above, the artificial turf infill material can comprise at least one of silica sand, rubber crumb granules, organic component, ethylene propylene diene monomer (EPDM) rubber, thermoplastic elastomers, polyurethane or any combination thereof. It is further understood that the reclaimed artificial turf material used herein can comprise a thermoset polymer, a thermoplastic polymer or any combination thereof. In still further aspects, and as disclosed herein the reclaimed artificial turf material can comprise a polyolefin, polyamide, polystyrene, polyurethane, polyester, polyacrylic, polyvinyl chloride, or any combination thereof.

In still further aspects and as described above, the formed composite blend further comprises at least one performance additive. In such aspects, the at least one performance additive comprises a virgin polymeric material, high denier fibers, a low melt fibers, a resilient material, foam chips, rubber chips, cork, wood chips, silica sand, adhesive material, binder fibers, or any combination thereof. It is understood that any performance additive described herein can be utilized to form the composite blend. In certain aspects, in addition to the disclosed above performance additives, other additives such as modifiers, colorants, plasticizers, elastomers, compatibilizers, antimicrobials, and UV stabilizers can be used to form the composite blend. In some exemplary aspects, the modifiers used to form the composite blend can include without limitation wax, EPDM rubber; high and low density polyethylene; or high and low density polypropylene. The use of modifiers or elastomers can further enhance the flex properties. Suitable colorants include dyes and pigments; red, green, blue, black or any number of different colors can be added. However, in some aspects, colorants may have very little effect due to the dark nature of the material.

In still further aspects, the composite blend disclosed herein can comprise at least one reclaimed carpet material. Similarly, to reclaimed artificial turf material, the reclaimed carpet material can comprise any carpet materials known in the art. In some aspects, the reclaimed turf and carpet materials comprise a post-consumer, a post-industrial material or a combination thereof. In still further aspects, the reclaimed carpet material can comprise any material disclosed above. It is understood that any component of the reclaimed carpet material can be used, for example and without limitation, a face layer, an adhesive layer, a precoat layer, a backing layer, a secondary backing layer, an underlayment, a cushioning material, an infill material, or a scrim can be used to form the composite blend.

In still further aspects, the binder used to form the composite blend can be any binder known in the art. In still further aspects, the binder can comprise a low melt fiber disclosed herein. In still further aspects, the binder can comprise a low melt powder. In still further aspects, the binder can comprise bi-component fibers.

In other aspects, the step of forming the composite blend into a composite web can comprise any methods known in the art. In some exemplary aspects, the step can include, but is not limited to, conventional airlaying, cross-lapping, carding, needle punching, or thermoforming technique, or any combination thereof.

In still further aspects, the composite nonwoven pad formed in step c) has a face surface and an opposed back surface. In yet other aspects, methods disclosed herein comprise a step of adding a scrim material. In such aspects, after step c) a reinforcing scrim is adhered to at least one of the face surface or the back surface of the composite nonwoven pad. In still other aspects, the reinforcing scrim is adhered during step c). In such aspect, the reinforcing scrim is adhered to the at least one of the face surface or the back surface simultaneously with the heat setting of the binder.

It is understood that the scrim material can comprises any known in the art materials. In some aspects, the scrim comprises a non-woven fiberglass, a wet-laid fiberglass, a non-woven thermoplastic fabric, a woven thermoplastic fiber, or a combination thereof. In certain aspects, the reinforcing scrim is permeable on the top. In still further aspects, the reinforcing scrim is permeable at the bottom. In still further aspects, the reinforcing scrim is impermeable at the bottom. In yet other aspects, the reinforcing scrim is permeable on the top and permeable on the bottom. In still further aspects, the reinforcing scrim is permeable on the top and impermeable at the bottom. In the aspects where the reinforcing scrim is impermeable at the bottom the disclosed pad behaves as a pad having drainage in a lateral direction. In still further aspects, a polyethylene extruded sheet can be applied to the bottom of the pad to seal the pad. In yet other aspects, any other film or an impermeable spray-coat can be applied to the bottom of the pad.

In still further aspects, the method disclosed herein provides for the pad comprising the nonwoven pad having a thickness and width as described above. In still further aspects, the method disclosed herein provide for the pad having a density from about 0.5 to about 30 lbs/ft3, including exemplary values of about 1 lbs/ft3, about 2 lbs/ft3, about 3 lbs/ft3, about 4 lbs/ft3, about 5 lbs/ft3, about 6 lbs/ft3, about 7 lbs/ft3, about 8 lbs/ft3, about 9 lbs/ft3, about 10 lbs/ft3, about 11 lbs/ft3, about 12 lbs/ft3, about 13 lbs/ft3, about 14 lbs/ft3, about 15 lbs/ft3, about 16 lbs/ft3, about 17 lbs/ft3, about 18 lbs/ft3, about 19 lbs/ft3, about 20 lbs/ft3, about 21 lbs/ft3, about 22 lbs/ft3, about 23 lbs/ft3, about 24 lbs/ft3, about 25 lbs/ft3, about 26 lbs/ft3, about 27 lbs/ft3, about 28 lbs/ft3, and about 29 lbs/ft3. In yet other aspects, the pad can have a density value between any two foregoing values. For example, the pad can have a density value in the range from about 2 lbs/ft3 to about 30 lbs/ft3, or from 10 lbs/ft3 to about 20 lbs/ft3. It is further understood that the methods disclosed herein provides for the pad that can have regions or portions of varying densities as described herein. In still further aspects, the pad can be further compressed to any volume predetermined by one of ordinary skill in the art. In certain aspects, the pad can be compressed to 20%, 30%, 40%, 50%, 60%, 70%, 80%, or 90%. In certain aspects, the pad can be further compressed via calendaring or any other known in the art method to increase material density and rigidity.

In still further aspects, the method disclosed herein provides for a pad that when it is present as a component in a turf system, the resulting turf system can exhibit Gmax and HIC values as disclosed above.

In still further aspects, the method of making the inventive pad further comprises a step of forming a plurality of channels in the composite nonwoven pad, wherein the plurality of channels extends from the face surface to the opposed back surface. In such aspects, each of the plurality of channels has a first outer periphery on the face surface and a second outer periphery on the opposed back surface, wherein the first and second outer periphery define a diameter of the channel, and wherein each channel in the plurality of channels is spaced apart along the length of the nonwoven pad. It is understood that such channels can be made by any methods known in the art. In certain aspect, the methods used to create the channels can comprise laser cutting, ultrasonic caning, water jet cutting, dye currying, embossing with an engraved belt, CNC (computer numerical control) routing, drilling, spiking, and the like.

It is understood that the plurality of channels formed by the disclosed method can be circular in cross-section, or can have any of various other cross-sectional shapes, including but is not limited to elliptical shape, oval shape, polygonal shape, star like shape, and like. In certain aspects, each of the plurality of channels can have a diameter from about 1 mm to about 15 mm, including exemplary values of about 2 mm, about 3 mm, about 4 mm, about 5 mm, about 6 mm, about 7 mm, about 8 mm, about 9 mm, about 10 mm, about 11 mm, about 12 mm, about 13 mm, and about 14 mm. It is further understood that each of the plurality of the channels can have any diameter between any foregoing values.

Yet in other aspects, the plurality of channels present in the shock absorbing pad have a percent open area from about 1% to about 20% based on 1 $m^2$ of the pad, including exemplary values of about 2%, about 3%, about 4%, about 5%, about 6%, about 7%, about 8%, about 9%, about 11%, about 12%, about 13%, about 14%, about 15%, about 16%, about 17%, about 18%, and about 19% based on 1 $m^2$ of the pad.

It is understood that the pad formed by the disclosed methods can have a vertical and/or horizontal drainage that can accommodate any disclosed above value of fluid flow.

In certain aspects, the method further comprises a step of adhering a polymer film to the back surface of the nonwoven pad. In some aspects, the polymer film disclosed herein is a fluid barrier. In yet other aspects, the polymer film is a moisture barrier film. In yet other aspects, the polymer film is fluid impermeable. In still further aspects, the polymer film is substantially impermeable. In yet other aspects, the polymer film is semipermeable material. In certain aspect, the polymer film is impermeable or substantially impermeable to gases and/or fluids. In one aspect, the polymer film is impermeable (or substantially impermeable) to aqueous fluids. In another aspect, the polymer film is impermeable (or substantially impermeable) to non-aqueous fluids. In further exemplary aspects, the polymer film is impermeable (or substantially impermeable) to water, human or pet bodily fluids, food fluids, food processing fluids, rain, or snow.

In yet other aspects, the polymer film disclosed herein can be any polymer film or moisture barrier film disclosed above. In certain aspects, the polymer film disclosed herein is an extruded film. In yet other aspects, the polymer film disclosed herein is a blown film. In a yet further aspect, the polymer film is a cast film. In a still further aspect, the polymer film is an engineered film. The term "engineered film" as used herein refers to a polymer film comprising same or different polymers and copolymers, wherein the film is formed by various techniques to ensure desirable properties. In some aspects, the engineered film is a reinforced film. In some aspects, and without limitation, the engineered reinforced film can comprise a plurality of layers of the same or different polymer or copolymer. In other aspects, the engineered film can comprise layers of polyethylene film sandwiched with a layer of polyester. In yet further aspects, the engineered film can comprise layers of polyethylene and polypropylene, or layers of polyethylene and chemically resistant ethylene vinyl alcohol (EVOH) copolymer. In certain aspects, the engineered film used in the current disclosure can be purchased from Raven Industries.

In some aspects, the polymer film is continuous. In other aspects, the polymer film is substantially free of perforations or pinholes. In yet other aspects, the polymer film is continuous and substantially free of perforations.

In still further aspects, the second outer periphery of the plurality of channels on the back surface opens to the polymer film attached to the back surface of the pad. In such aspects, the polymer film provides a plane for a lateral drainage of the fluid conveyed by the plurality of channels. In yet other aspects, the disclosed pad comprising the polymer film can provide a free flowing lateral drainage system as described above.

In yet further aspects, the method disclosed herein provides for the pad comprising the composite nonwoven pad that comprises opposed first and second side edges and wherein the method further comprises profiling the plurality of side edges to define an edge locking structure. The disclosed pads can be installed to provide a plurality of adjacent shock absorbing pads in any selected orientation. Each of the plurality of adjacent shock absorbing pads comprises a nonwoven pad comprising a plurality of side edges extending between the opposed face and back surfaces, wherein the plurality of side edges define an edge locking structure. It is understood that the interlocking structures can be any comprise any structures known in the art and defined herein.

In still further aspects, the method disclosed herein provides for a pad that can be provided in any form known in the art. In some aspects, the nonwoven pad has a continuous length and is rolled into a roll good. In such aspects, the roll is unrolled on installation site. In other aspects, the nonwoven pad can be provided in a slab form. In such aspects, the pad forms a plurality of adjacent shock pads present in interlocking installation. In still further aspects, the face and opposed back surface of the nonwoven pad disclosed herein is substantially horizontal.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A playing surface assembly that defines at least a portion of a playing surface, the playing surface assembly comprising: a backing having a top surface; a plurality of reinforcement elements secured to and extending upwardly from the backing; and an infill material defining a top surface of the playing surface assembly and having a height measured from the top surface of the backing, wherein each reinforcement element of the plurality of reinforcement elements has a top end and a reveal distance corresponding to a vertical spacing between the top surface of the playing surface assembly and the top end of the reinforcement element, wherein a ratio between the height of the infill material and the reveal distance of each reinforcement element is at least 7:1, wherein the plurality of reinforcement elements are configured to restrict lateral and vertical migration of the infill material, and wherein the infill material is the primary source of performance characteristics of the playing surface assembly.

Aspect 2: The playing surface assembly of aspect 1, wherein the reveal distance of each reinforcement element is less than 0.25 inches.

Aspect 3: The playing surface assembly of aspect 1, wherein the reveal distance of at least a portion of the reinforcement elements of the plurality of reinforcement elements have a reveal distance that is less than 0.125 inches.

Aspect 4: The playing surface assembly of aspect 1, wherein each reinforcement element of the plurality of reinforcement elements has an upper portion positioned above the backing, and wherein at least 80% of a surface area of the upper portion of each reinforcement element is embedded within the infill material.

Aspect 5: The playing surface assembly of aspect 4, wherein at least 90% of the surface area of the upper portion of each reinforcement element is embedded within the infill material.

Aspect 6. The playing surface assembly of any one of the preceding aspects, wherein the plurality of reinforcement elements are tufted into the backing.

Aspect 7: The playing surface assembly of aspect 6, wherein the plurality of tufted reinforcement elements are cut yarns.

Aspect 8: The playing surface assembly of aspect 6, wherein the plurality of tufted reinforcement elements are loop yarns.

Aspect 9: The playing surface assembly of aspect 6, wherein the plurality of tufted reinforcement elements comprise monofilament fibers.

Aspect 10: The playing surface assembly of aspect 6, wherein the plurality of tufted reinforcement elements comprise slit films.

Aspect 11: The playing surface assembly of aspect 6, wherein the plurality of tufted reinforcement elements comprise thatch yarns.

Aspect 12: The playing surface of any one of aspects 1-5, wherein the plurality of reinforcement elements are integrally formed with the backing as a single monolithic structure.

Aspect 13: The playing surface of any one of aspects 1-5, wherein the plurality of reinforcement elements are held together by a binder.

Aspect 14: The playing surface assembly of any one of the preceding aspects, wherein the backing is a woven backing.

Aspect 15: The playing surface assembly of any one of aspects 1-13, wherein the backing is a non-woven backing.

Aspect 16: The playing surface assembly of any one of aspects 1-13, wherein the backing is permeable to liquid.

Aspect 17: The playing surface assembly of any one of aspects 1-13, wherein the backing is impermeable to liquid.

Aspect 18: The playing surface assembly of any one of aspects 1-13, wherein the backing comprises at least one coating or film configured to increase durability of the playing surface assembly.

Aspect 19: The playing surface assembly of any one of the preceding aspects, wherein the infill material comprises clay.

Aspect 20: The playing surface assembly of aspect 19, wherein the clay is porous.

Aspect 21: The playing surface assembly of aspect 19, wherein the clay is non-porous.

Aspect 22: The playing surface assembly of any one of aspects 19-21, wherein the clay has a serve size ranging from about 20 to about 40.

Aspect 23: The playing surface assembly of any one of aspects 1-18, wherein the infill material comprises recycled particulate material.

Aspect 24: The playing surface assembly of any one of aspects 1-18, wherein the infill material comprises TPE, EPDM, coconut husks, walnut shells, crushed brick, sand, or combinations thereof.

Aspect 25: The playing surface assembly of any one of aspects 1-18, wherein the plurality of reinforcement elements have a color that matches or substantially matches a color of the infill material.

Aspect 26: A system comprising: a first playing surface assembly according to any one of the preceding claims; and a second playing surface assembly that cooperates with the first playing surface assembly to define at least a portion of a playing field, court, or track.

Aspect 27: The system of aspect 26, wherein the second playing surface assembly comprises: a backing; a plurality of artificial turf ribbons secured to and extending upwardly from the backing; and an infill material supported by the backing, wherein each artificial turf ribbon of the plurality of artificial turf ribbons has a top end and a reveal distance corresponding to a vertical spacing between a top surface of the infill material and the top end of the artificial turf ribbon, wherein the reveal distance of each artificial turf ribbon is at least 0.75 inches.

Aspect 28: The system of aspect 26 or aspect 27, wherein the first playing surface defines a pitching mound, infield, or warning track of a baseball field.

Aspect 29: A method of using the playing surface assembly of any one of aspects 1-25.

Aspect 30: The method of aspect 29, wherein the method comprises: modifying one or more properties of the infill material to adjust one or more playing characteristics of the playing surface assembly.

Aspect 31: The method of aspect 29, wherein the method comprises: watering the playing surface assembly to adjust one or more playing characteristics of the playing surface assembly.

Aspect 32: A method of making the playing surface assembly of any one of aspects 1-25.

Aspect 33: A system comprising: first and second playing surface assemblies that cooperate to define at least a portion of a playing field, court, or track, at least the first playing surface assembly having: a backing having a top surface; a plurality of reinforcement elements secured to and extending upwardly from the backing; and an infill material defining a top surface of the playing surface assembly and having a height measured from the top surface of the backing, wherein each reinforcement element of the plurality of reinforcement elements has a top end and a reveal distance corresponding to a vertical spacing between the top surface of the playing surface assembly and the top end of the reinforcement element, wherein the plurality of reinforcement elements of the playing surface assembly are configured to restrict lateral and vertical migration of the infill material of the playing surface assembly, wherein the infill material of each playing surface assembly is the primary source of performance characteristics of the playing surface assembly, wherein a ratio between the height of the infill material of the first playing surface assembly and the reveal distance of each reinforcement element of the first playing surface assembly is at least 7:1, wherein the infill material of the first playing surface assembly comprises clay, and wherein portions of each reinforcement element of the first playing surface assembly extend above the infill material of the first playing surface assembly and have a color that matches or substantially matches a color of the infill material.

Aspect 34: The system of aspect 33, wherein the second playing surface assembly is configured to simulate grass.

Aspect 35: The system of aspect 33 or aspect 34, wherein the second playing surface assembly comprises: a backing having a top surface; a plurality of reinforcement elements secured to and extending upwardly from the backing; and an infill material defining a top surface of the second playing surface assembly and having a height measured from the top surface of the backing, wherein each reinforcement element of the plurality of reinforcement elements of the second playing surface assembly has a top end and a reveal distance corresponding to a vertical spacing between the top surface of the second playing surface assembly and the top end of the reinforcement element, wherein the plurality of reinforcement elements of the second playing surface assembly are configured to restrict lateral and vertical migration of the infill material of the second playing surface assembly, wherein the infill material of the second playing surface assembly is the primary source of performance characteristics of the second playing surface assembly, and wherein a ratio between the height of the infill material of the second playing surface assembly and the reveal distance of each reinforcement element of the second playing surface assembly is at least 7:1.

Aspect 36: The system of aspect 33 or aspect 34, wherein the second playing surface assembly comprises: a backing; a plurality of artificial turf ribbons secured to and extending upwardly from the backing; and an infill material supported by the backing, wherein each artificial turf ribbon of the plurality of artificial turf ribbons has a top end and a reveal distance corresponding to a vertical spacing between a top surface of the infill material and the top end of the artificial turf ribbon, wherein the reveal distance of each artificial turf ribbon is at least 0.75 inches.

Aspect 37: The system of aspect 34, wherein the first playing surface assembly forms a warning track of a baseball field.

Aspect 38: The system of aspect 34, wherein the first playing surface assembly forms an infield of a baseball field.

Aspect 39: The system of aspect 35, further comprising a third playing surface assembly, wherein the third playing surface assembly comprises: a backing; a plurality of artificial turf ribbons secured to and extending upwardly from the backing; and an infill material supported by the backing, wherein each artificial turf ribbon of the plurality of artificial turf ribbons has a top end and a reveal distance corresponding to a vertical spacing between a top surface of the infill material and the top end of the artificial turf ribbon, wherein the reveal distance of each artificial turf ribbon is at least 0.75 inches.

Aspect 40: The system of aspect 39, wherein the infill material of the second playing surface assembly comprises clay, and wherein portions of each reinforcement element of the second playing surface assembly extend above the infill material of the second playing surface assembly and have a color that matches or substantially matches a color of the infill material of the second playing surface assembly.

Aspect 41: The system of aspect 40, wherein the first playing surface assembly forms an infield of a baseball field, wherein the second playing surface assembly forms a warning track of the baseball field, and wherein the third playing surface assembly forms a grass area of the baseball field.

Aspect 42: The system of any one of aspects 33-41, wherein the reveal distance of each reinforcement element of the first playing surface assembly is less than 0.25 inches.

Aspect 43: The system of any one of aspects 33-42, wherein each reinforcement element of the plurality of reinforcement elements of the first playing surface assembly has an upper portion positioned above the backing, and wherein at least 80% of a surface area of the upper portion of each reinforcement element of the first playing surface assembly is embedded within the infill material of the first playing surface assembly.

Aspect 44: The system of any one of aspects 33-43, wherein the plurality of reinforcement elements of the first playing surface assembly are tufted into the backing of the first playing surface assembly.

Aspect 45: The system of any one of aspects 33-43, wherein the plurality of reinforcement elements of the first playing surface assembly are integrally formed with the backing of the first playing surface assembly as a single monolithic structure.

Aspect 46: The system of any one of aspects 33-45, wherein the plurality of reinforcement elements of the first playing surface assembly are held together by a binder.

Aspect 47: The system of any one of aspects 33-46, wherein the backing of the first playing surface assembly is a woven backing.

Aspect 48: The system of any one of aspects 33-46, wherein the backing of the first playing surface assembly is a non-woven backing.

Aspect 49: The system of any one of aspects 33-48, wherein the backing of the first playing surface assembly is permeable to liquid.

Aspect 50: The system of any one of aspects 33-49, wherein the backing of the first playing surface assembly comprises at least one coating or film configured to increase durability of the first playing surface assembly.

Aspect 51: The system of any one of aspects 33-50, wherein the clay is porous.

Aspect 52: The system of any one of aspects 33-50, wherein the clay is non-porous.

Aspect 53: The system of any one of aspects 33-52, wherein the clay has a serve size ranging from about 20 to about 40.

Aspect 54: The system of aspect 35, wherein the infill material of the second playing surface assembly comprises recycled particulate material.

Aspect 55: The system of aspect 35, wherein the infill material of the second playing surface assembly comprises TPE, EPDM, coconut husks, walnut shells, crushed brick, sand, or combinations thereof.

Aspect 56. The system of aspect 35, wherein the plurality of reinforcement elements of the second playing surface assembly have a color that matches or substantially matches a color of the infill material of the second playing surface assembly.

Aspect 57: A playing surface assembly that defines at least a portion of a playing surface, the playing surface assembly comprising: a backing having a top surface; a plurality of reinforcement elements secured to and extending upwardly from the backing; and an infill material defining a top surface of the playing surface assembly and having a height measured from the top surface of the backing, wherein each reinforcement element of the plurality of reinforcement elements has a top end and a reveal distance corresponding to a vertical spacing between the top surface of the playing surface assembly and the top end of the reinforcement element, wherein a ratio between the height of the infill material and the reveal distance of each reinforcement element is at least 7:1, wherein the plurality of reinforcement elements are configured to restrict lateral and vertical migration of the infill material, wherein the infill material is the primary source of performance characteristics of the playing surface assembly, wherein the playing surface assembly has a surface impact attenuation (gmax) ranging from 180 to 250.

Aspect 58: The playing surface assembly of aspect 57, wherein the playing surface assembly has a rotational traction, indicative of a torque required to release cleats from the playing surface assembly, ranging from 60 N-m to 100 N-m.

Aspect 59: The playing surface assembly of aspect 57 or aspect 58, wherein the infill material comprises clay.

Aspect 60: A playing surface assembly that defines at least a portion of a playing surface, the playing surface assembly comprising: a backing having a top surface; a plurality of reinforcement elements secured to and extending upwardly from the backing; and an infill material defining a top surface of the playing surface assembly and having a height measured from the top surface of the backing, wherein each reinforcement element of the plurality of reinforcement elements has a top end and a reveal distance corresponding to a vertical spacing between the top surface of the playing surface assembly and the top end of the reinforcement element, wherein a ratio between the height of the infill material and the reveal distance of each reinforcement element is at least 7:1, wherein the plurality of reinforcement elements are configured to restrict lateral and vertical migration of the infill material, wherein the infill material is the primary source of performance characteristics of the playing surface assembly, wherein the playing surface assembly has a rotational traction, indicative of a torque required to release cleats from the playing surface assembly, ranging from 60 N-m to 100 N-m.

Aspect 61: The playing surface assembly of aspect 60, wherein the infill material comprises clay.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A system comprising:

first and second playing surface assemblies that cooperate to define at least a portion of a playing field, court, or track, at least the first playing surface assembly having:

a backing having a top surface;

a plurality of reinforcement elements secured to and extending upwardly from the backing; and an infill material defining a top surface of the playing surface assembly and having a height measured from the top surface of the backing, wherein each reinforcement element of the plurality of reinforcement elements has a top end and a reveal distance corresponding to a vertical spacing between the top surface of the playing surface assembly and the top end of the reinforcement element, wherein the plurality of reinforcement elements of the playing surface assembly are configured to restrict lateral and vertical migration of the infill material of the playing surface assembly, wherein the infill material of each playing surface assembly is the primary source of performance characteristics of the playing surface assembly, wherein a ratio between the height of the infill material of the first playing surface assembly and the reveal distance of each reinforcement element of the first playing surface assembly is at least 7:1, wherein the infill material of the first playing surface assembly comprises clay, and wherein portions of each reinforcement element of the first playing surface assembly extend above the infill material of the first playing surface assembly and have a color that matches or substantially matches a color of the infill material.

2. The system of claim 1, wherein the second playing surface assembly is configured to simulate grass.

3. The system of claim 2, wherein the second playing surface assembly comprises:

a backing;

a plurality of artificial turf ribbons secured to and extending upwardly from the backing; and an infill material supported by the backing, wherein each artificial turf ribbon of the plurality of artificial turf ribbons has a top end and a reveal distance corresponding to a vertical spacing between a top surface of the infill material and the top end of the artificial turf ribbon, wherein the reveal distance of each artificial turf ribbon is at least 0.75 inches.

4. The system of claim 2, wherein the first playing surface assembly forms a warning track of a baseball field.

5. The system of claim 2, wherein the first playing surface assembly forms an infield of a baseball field.

6. The system of claim 1, wherein the second playing surface assembly comprises:

a backing having a top surface;

a plurality of reinforcement elements secured to and extending upwardly from the backing; and an infill material defining a top surface of the second playing surface assembly and having a height measured from the top surface of the backing, wherein each reinforcement element of the plurality of reinforcement elements of the second playing surface assembly has a top end and a reveal distance corresponding to a vertical spacing between the top surface of the second playing surface assembly and the top end of the reinforcement element, wherein the plurality of reinforcement elements of the second playing surface assembly are configured to restrict lateral and vertical migration of the infill material of the second playing surface assembly, wherein the infill material of the second playing surface assembly is the primary source of performance characteristics of the second playing surface assembly, and wherein a ratio between the height of the infill material of the second playing surface assembly and the reveal distance of each reinforcement element of the second playing surface assembly is at least 7:1.

7. The system of claim 6, further comprising a third playing surface assembly, wherein the third playing surface assembly comprises:

a backing;

a plurality of artificial turf ribbons secured to and extending upwardly from the backing; and an infill material supported by the backing, wherein each artificial turf ribbon of the plurality of artificial turf ribbons has a top end and a reveal distance corresponding to a vertical spacing between a top surface of the infill material and the top end of the artificial turf ribbon, wherein the reveal distance of each artificial turf ribbon is at least 0.75 inches.

8. The system of claim 7, wherein the infill material of the second playing surface assembly comprises clay, and wherein portions of each reinforcement element of the second playing surface assembly extend above the infill material of the second playing surface assembly and have a color that matches or substantially matches a color of the infill material of the second playing surface assembly.

9. The system of claim 8, wherein the first playing surface assembly forms an infield of a baseball field, wherein the second playing surface assembly forms a warning track of the baseball field, and wherein the third playing surface assembly forms a grass area of the baseball field.

10. The system of claim 6, wherein the infill material of the second playing surface assembly comprises recycled particulate material.

11. The system of claim 6, wherein the infill material of the second playing surface assembly comprises TPE, EPDM, coconut husks, walnut shells, crushed brick, sand, or combinations thereof.

12. The system of claim 6, wherein the plurality of reinforcement elements of the second playing surface assembly have a color that matches or substantially matches a color of the infill material of the second playing surface assembly.

13. The system of claim 1, wherein the reveal distance of each reinforcement element of the first playing surface assembly is less than 0.25 inches.

14. The system of claim 1, wherein each reinforcement element of the plurality of reinforcement elements of the first playing surface assembly has an upper portion positioned above the backing, and wherein at least 80% of a surface area of the upper portion of each reinforcement element of the first playing surface assembly is embedded within the infill material of the first playing surface assembly.

15. The system of claim 1, wherein the plurality of reinforcement elements of the first playing surface assembly are tufted into the backing of the first playing surface assembly.

16. The system of claim 1, wherein the plurality of reinforcement elements of the first playing surface assembly are integrally formed with the backing of the first playing surface assembly as a single monolithic structure.

17. The system of claim 1, wherein the plurality of reinforcement elements of the first playing surface assembly are held together by a binder.

18. The system of claim 1, wherein the backing of the first playing surface assembly is a woven backing.

19. The system of claim 1, wherein the backing of the first playing surface assembly is a non-woven backing.

20. The system of claim 1, wherein the backing of the first playing surface assembly is permeable to liquid.

21. The system of claim 1, wherein the backing of the first playing surface assembly comprises at least one coating or film configured to increase durability of the first playing surface assembly.

22. The system of claim 1, wherein the clay is porous.

23. The system of claim 1, wherein the clay is non-porous.

24. The system of claim 1, wherein the clay has a serve size ranging from about 20 to about 40.

25. A playing surface assembly that defines at least a portion of a playing surface, the playing surface assembly comprising:

a backing having a top surface;

a plurality of reinforcement elements secured to and extending upwardly from the backing; and an infill material defining a top surface of the playing surface assembly and having a height measured from the top surface of the backing, wherein each reinforcement element of the plurality of reinforcement elements has a top end and a reveal distance corresponding to a vertical spacing between the top surface of the playing surface assembly and the top end of the reinforcement element, wherein a ratio between the height of the infill material and the reveal distance of each reinforcement element is at least 7:1, wherein the plurality of reinforcement elements are configured to restrict lateral and vertical migration of the infill material, wherein the infill material is the primary source of performance characteristics of the playing surface assembly, wherein the playing surface assembly has a surface impact attenuation (gmax) ranging from 180 to 250.

26. The playing surface assembly of claim 25, wherein the playing surface assembly has a rotational traction, indicative of a torque required to release cleats from the playing surface assembly, ranging from 60 N-m to 100 N-m.

27. The playing surface assembly of claim 25, wherein the infill material comprises clay.

* * * * *